US010822769B2

(12) United States Patent
Shimano et al.

(10) Patent No.: US 10,822,769 B2
(45) Date of Patent: Nov. 3, 2020

(54) EARTHMOVING MACHINE AND CONTROL METHOD

(71) Applicant: KOMATSU LTD., Tokyo (JP)

(72) Inventors: Yuki Shimano, Tokyo (JP); Toru Matsuyama, Tokyo (JP); Takuya Sonoda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 179 days.

(21) Appl. No.: 15/757,096

(22) PCT Filed: Apr. 10, 2017

(86) PCT No.: PCT/JP2017/014607
§ 371 (c)(1),
(2) Date: Mar. 2, 2018

(87) PCT Pub. No.: WO2018/189765
PCT Pub. Date: Oct. 18, 2018

(65) Prior Publication Data

US 2019/0078291 A1 Mar. 14, 2019

(51) Int. Cl.

| | |
|---|---|
| ***E02F 3/43*** | (2006.01) |
| ***E02F 9/26*** | (2006.01) |
| ***E02F 9/20*** | (2006.01) |
| ***E02F 9/22*** | (2006.01) |

(52) U.S. Cl.
CPC ..... *E02F 3/437* (2013.01); *E02F 3/435* (2013.01); *E02F 9/20* (2013.01); *E02F 9/2004* (2013.01); *E02F 9/2203* (2013.01); *E02F 9/2296* (2013.01); *E02F 9/262* (2013.01); *E02F 9/265* (2013.01)

(58) Field of Classification Search
CPC ..... E02F 3/435; E02F 3/437; E02F 3/439
USPC ..... 172/4, 4.5
See application file for complete search history.

(56) References Cited

U.S. PATENT DOCUMENTS

| | | | | |
|---|---|---|---|---|
| 6,076,029 A * | 6/2000 | Watanabe | ..... | E02F 3/437 701/50 |
| 6,098,322 A | 8/2000 | Tozawa et al. | | |
| 9,020,709 B2 * | 4/2015 | Matsuyama | ..... | E02F 3/435 172/2 |
| 9,080,317 B2 * | 7/2015 | Matsuyama | ..... | E02F 3/435 |

(Continued)

FOREIGN PATENT DOCUMENTS

| | | |
|---|---|---|
| CN | 1651666 A | 8/2005 |
| CN | 102720231 A | 10/2012 |

(Continued)

*Primary Examiner* — Gary S Hartmann
(74) *Attorney, Agent, or Firm* — Faegre Drinker Biddle & Reath LLP

(57) ABSTRACT

An earthmoving machine includes a work implement, a distance calculation unit, and a hydraulic cylinder control unit. The work implement includes a boom, an arm, and a bucket. The distance calculation unit calculates a distance between a monitoring point in the bucket and design topography representing an aimed shape of a land grading target. The hydraulic cylinder control unit outputs a command signal for lowering the boom when the distance between the monitoring point and the design topography is equal to or smaller than a prescribed value and when the bucket is expected to move in such a direction that the monitoring point moves away from the design topography as a result of an operation of the arm.

4 Claims, 12 Drawing Sheets

(56) References Cited

U.S. PATENT DOCUMENTS

| | | | | |
|---|---|---|---|---|
| 9,322,149 | B2 * | 4/2016 | Takaura | E02F 9/2029 |
| 9,458,598 | B2 * | 10/2016 | Takaura | E02F 3/437 |
| 9,834,905 | B2 * | 12/2017 | Matsuyama | E02F 3/437 |
| 2013/0315699 | A1 | 11/2013 | Matsuyama | |
| 2015/0308082 | A1 | 10/2015 | Takaura et al. | |
| 2016/0010312 | A1 | 1/2016 | Kurihara et al. | |
| 2016/0040398 | A1 * | 2/2016 | Kitajima | E02F 3/435<br>701/50 |
| 2016/0097184 | A1 | 4/2016 | Matsuyama et al. | |

FOREIGN PATENT DOCUMENTS

| | | | |
|---|---|---|---|
| CN | 103857853 | A | 6/2014 |
| JP | S58-17938 | A | 2/1983 |
| JP | S58-36135 | B2 | 8/1983 |
| JP | H09-328774 | A | 12/1997 |
| JP | H10-252095 | A | 9/1998 |
| JP | 2014-084183 | A | 5/2014 |
| JP | 2014-101664 | A | 6/2014 |
| JP | 5548307 | B2 | 7/2014 |
| WO | WO-2014/167718 | A1 | 10/2014 |
| WO | WO 2014/192475 | A1 | 12/2014 |

* cited by examiner

EARTHMOVING MACHINE AND CONTROL METHOD

TECHNICAL FIELD

The present invention relates to an earthmoving machine and a control method.

BACKGROUND ART

An earthmoving machine such as a hydraulic excavator includes a work implement having a boom, an arm, and a bucket. In control of the earthmoving machine, automatic control in which a bucket is moved based on design topography which is an aimed shape of an excavation target has been known.

Japanese Patent Laying-Open No, 9-328774 (PTD 1) has proposed a scheme for automatic control of land grading work in which soil abutting to a bucket is plowed and leveled by moving a cutting edge of the bucket along a reference surface and a surface corresponding to the flat reference surface is made.

CITATION LIST

Patent Document

PTD 1: Japanese Patent Laying-Open No. 9-328774

SUMMARY OF INVENTION

Technical Problem

In land grading works, the land can desirably be graded with a simplified operation.

An object of the present invention is to provide a technique for grading land with a simplified operation.

Solution to Problem

In conventional land grading control, in order to avoid excavation deeper than design topography, control for forcibly automatically raising a boom when a monitoring point such as a cutting edge of a bucket is expected to be lower than the design topography is carried out.

The present inventor has found that topography over an area greater than in a conventional example can be graded while land grading control is carried out by automatically controlling a boom also when a monitoring point in a bucket moves away from design topography, and configured the present invention as follows.

An earthmoving machine according to the present invention includes a work implement, a distance calculation unit, and a control unit. The work implement includes a boom, an arm, and a bucket. The distance calculation unit calculates a distance between a monitoring point in the bucket and design topography representing an aimed shape of a land grading target. The control unit outputs a command signal for lowering the boom when the distance between the monitoring point and the design topography is equal to or smaller than a prescribed value and when the bucket is expected to move in such a direction that the monitoring point moves away from the design topography as a result of an operation of the arm.

Advantageous Effects of Invention

In connection with an earthmoving machine, land grading can be carried out with a simplified operation.

DESCRIPTION OF EMBODIMENTS

An embodiment according to the present invention will be described hereinafter with reference to the drawings. The present invention is not limited thereto. Requirements in each embodiment described below can be combined as appropriate. Some components may not be employed.

<Overall Structure of Earthmoving Machine>

Figure 1:
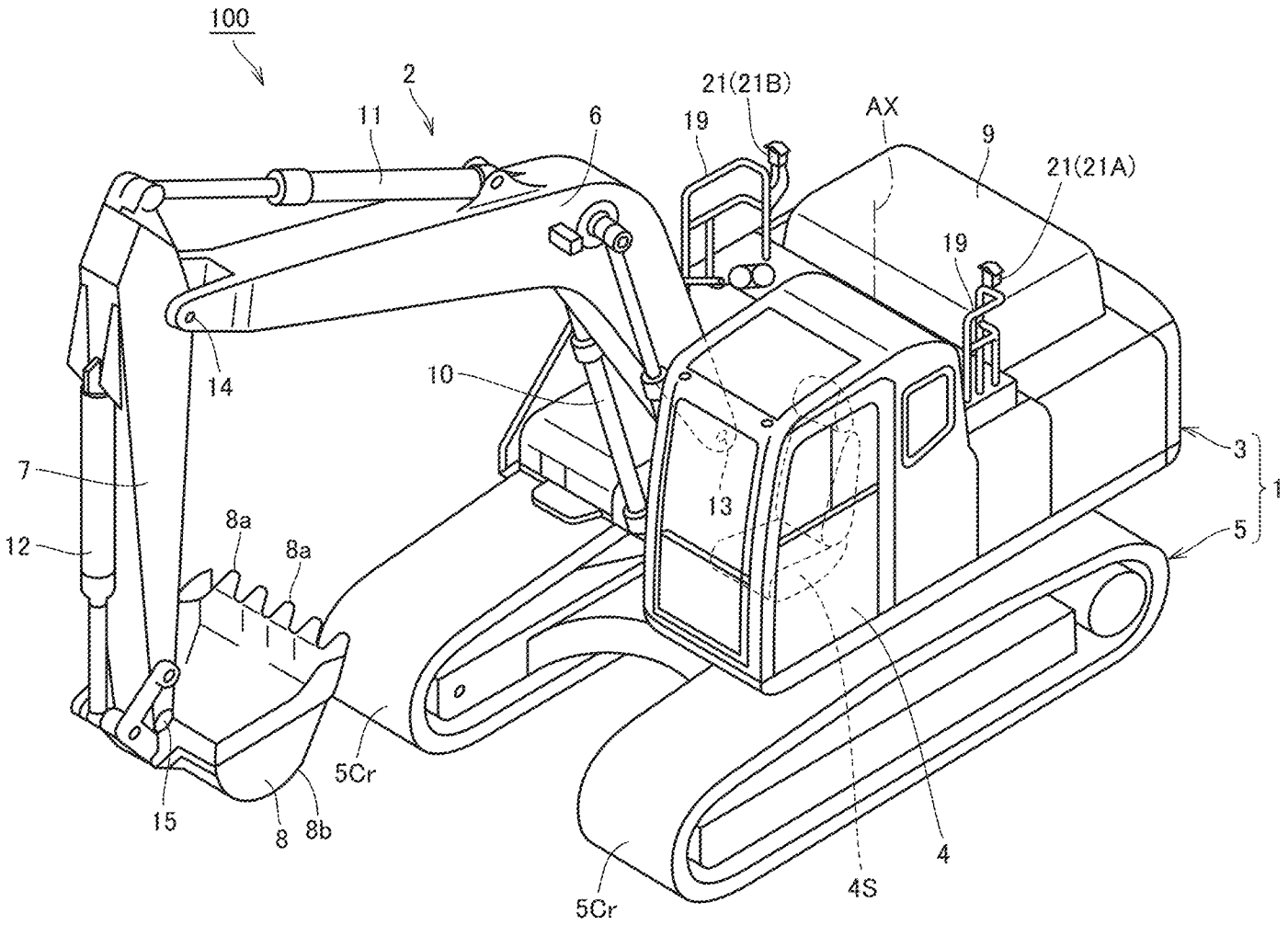
FIG. 1 shows an appearance of an earthmoving machine based on an embodiment.

FIG. 1 shows an appearance of an earthmoving machine 100 based on an embodiment. As shown in FIG. 1, in the present example, a hydraulic excavator will mainly be described by way of example as earthmoving machine 100.

Earthmoving machine 100 has a main body 1 and a work implement 2 operated with a hydraulic pressure. Main body 1 has a revolving unit 3 and a traveling apparatus 5. Traveling apparatus 5 has a pair of crawler belts 5Cr. Earthmoving machine 100 can travel as crawler belts 5Cr rotate. Traveling apparatus 5 may have wheels (tires).

Revolving unit 3 is arranged on traveling apparatus 5 and supported by traveling apparatus 5. Revolving unit 3 can revolve with respect to traveling apparatus 5, around an axis of revolution AX. Revolving unit 3 has an operator's cab 4. This operator's cab 4 is provided with an operator's seat 4S where an operator sits. The operator can operate earthmoving machine 100 in operator's cab 4.

Revolving unit 3 has an engine compartment 9 accommodating an engine and a counterweight provided in a rear portion of revolving unit 3. In revolving unit 3, a handrail 19 is provided in front of engine compartment 9. In engine compartment 9, an engine and a hydraulic pump which are not shown are arranged.

Work implement 2 is supported by revolving unit 3. Work implement 2 has a boom 6, an arm 7, and a bucket 8. Boom 6 is connected to revolving unit 3. Arm 7 is connected to boom 6. Bucket 8 is connected to arm 7.

A base end portion of boom 6 is connected to revolving unit 3 with a boom pin 13 being interposed. A base end portion of arm 7 is connected to a tip end portion of boom 6 with an arm pin 14 being interposed. Bucket 8 is connected to a tip end portion of arm 7 with a bucket pin 15 being interposed.

Boom 6 can pivot around boom pin 13. Arm 7 can pivot around arm pin 14. Bucket 8 can pivot around bucket pin 15. Each of arm 7 and bucket 8 is a movable member movable on a tip end side of boom 6.

In the present embodiment, positional relation among portions of earthmoving machine 100 will be described with work implement 2 being defined as the reference.

Boom 6 of work implement 2 pivots with respect to revolving unit 3, around boom pin 13 provided at the base end portion of boom 6. Movement of a specific portion of boom 6 which pivots with respect to revolving unit 3, for example, a tip end portion of boom 6, leaves a trace in an arc shape, and a plane including the arc is specified. When earthmoving machine 100 is planarly viewed, the plane is represented as a straight line. A direction of extension of this straight line is defined as a fore/aft direction of main body 1 of earthmoving machine 100 or revolving unit 3, and it is hereinafter also simply referred to as the fore/aft direction. A lateral direction (a direction of a vehicle width) of main body 1 of earthmoving machine 100 or a lateral direction of revolving unit 3 is orthogonal to the fore/aft direction in a plan view, and it is hereinafter also simply referred to as the lateral direction.

A side where work implement 2 protrudes from main body 1 of earthmoving machine 100 in the fore/aft direction is the fore direction and a direction opposite to the fore direction is the aft direction. A right side and a left side of the lateral direction when one faces front are the right direction and the left direction, respectively.

The fore/aft direction refers to a fore/aft direction of an operator who sits at an operator's seat in operator's cab 4. A direction in which the operator sitting at the operator's seat faces is defined as the fore direction and a direction behind the operator who sits at the operator's seat is defined as the aft direction. The lateral direction refers to a lateral direction of the operator who sits at the operator's seat. A right side and a left side at the time when the operator sitting at the operator's seat faces front are defined as the right direction and the left direction, respectively.

Work implement 2 has a boom cylinder 10, an arm cylinder 11, and a bucket cylinder 12. Boom cylinder 10 drives boom 6. Arm cylinder 11 drives arm 7. Bucket cylinder 12 drives bucket 8. Each of boom cylinder 10, arm cylinder 11, and bucket cylinder 12 is implemented by a hydraulic cylinder driven with a hydraulic oil.

Figure 2:
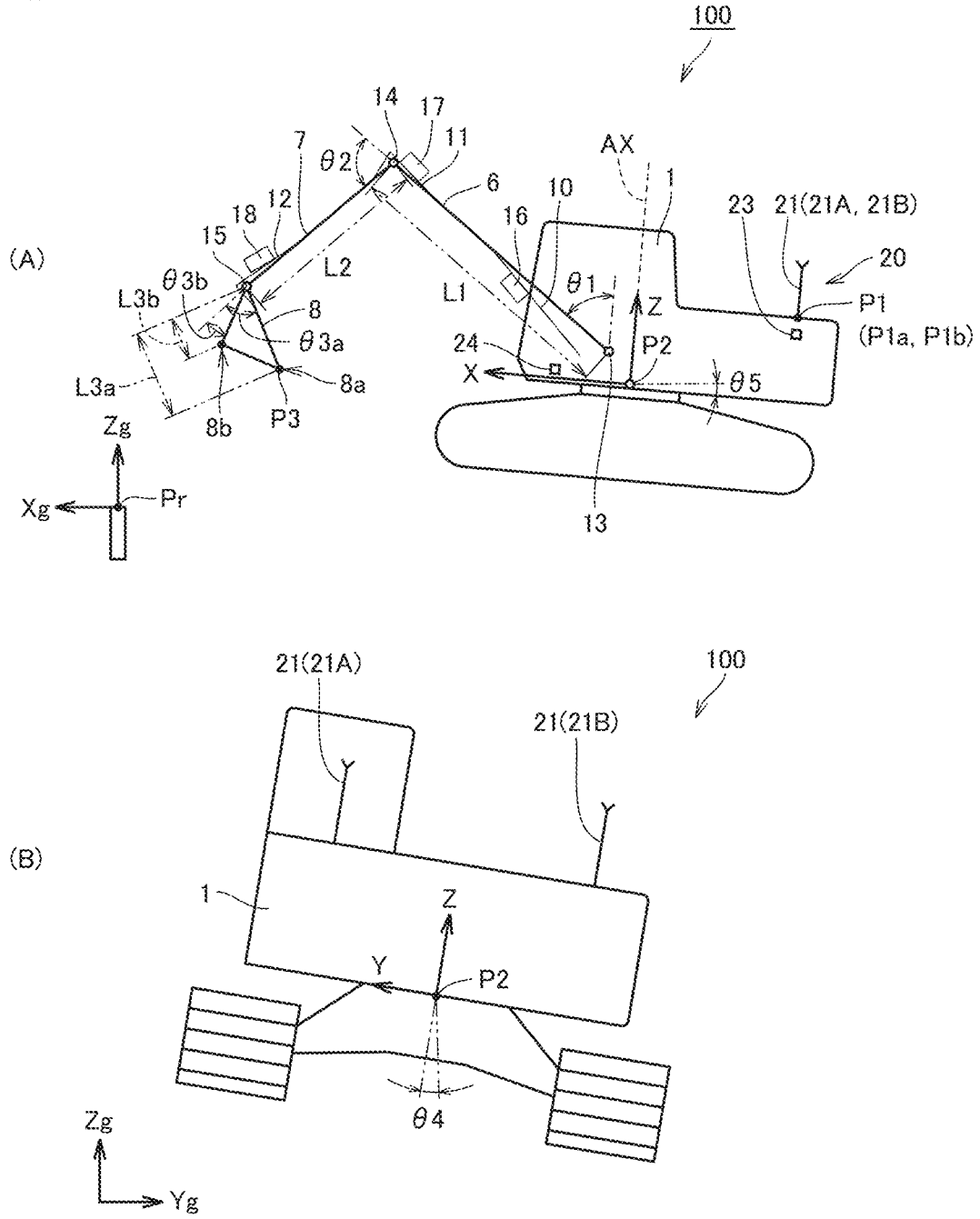
FIG. 2 is a diagram schematically illustrating the earthmoving machine based on the embodiment.

FIGS. 2 (A) and 2 (B) are diagrams schematically illustrating earthmoving machine 100 based on the embodiment. FIG. 2 (A) shows a side view of earthmoving machine 100. FIG. 2 (B) shows a rear view of earthmoving machine 100.

As shown in FIGS. 2 (A) and 2 (B), a length of boom 6, that is, a length from boom pin 13 to arm pin 14, is represented by L1. A length of arm 7, that is, a length from arm pin 14 to bucket pin 15, is represented by L2. A length of bucket 8, that is, a length from bucket pin 15 to a cutting edge 8*a* of bucket 8, is represented by L3*a*. Bucket 8 has a plurality of blades and a tip end portion of bucket 8 is referred to as cutting edge 8*a* in the present example. A length from bucket pin 15 to an outermost end on a rear surface side of bucket 8 (which is hereinafter called a rear surface end 8*b*) is represented by L3*b*. Cutting edge 8*a* and rear surface end 8*b* represent examples of monitoring points set in bucket 8 or examples of a plurality of monitoring portions of a monitoring point.

Bucket 8 does not have to have a blade. The tip end portion of bucket 8 may be formed from a steel plate having a straight shape.

Earthmoving machine 100 has a boom cylinder stroke sensor 16, an arm cylinder stroke sensor 17, and a bucket cylinder stroke sensor 18. Boom cylinder stroke sensor 16 is arranged in boom cylinder 10. Arm cylinder stroke sensor 17 is arranged in arm cylinder 11. Bucket cylinder stroke sensor 18 is arranged in bucket cylinder 12. Boom cylinder stroke sensor 16, arm cylinder stroke sensor 17, and bucket cylinder stroke sensor 18 are also collectively referred to as a cylinder stroke sensor.

A stroke length of boom cylinder 10 is found based on a result of detection by boom cylinder stroke sensor 16. A stroke length of arm cylinder 11 is found based on a result of detection by arm cylinder stroke sensor 17. A stroke length of bucket cylinder 12 is found based on a result of detection by bucket cylinder stroke sensor 18.

In the present example, stroke lengths of boom cylinder 10, arm cylinder 11, and bucket cylinder 12 are also referred to as a boom cylinder length, an arm cylinder length, and a bucket cylinder length, respectively. In the present example, a boom cylinder length, an arm cylinder length, and a bucket cylinder length are also collectively referred to as cylinder length data L. A scheme for detecting a stroke length with the use of an angle sensor can also be adopted.

Earthmoving machine 100 includes a position detection apparatus 20 which can detect a position of earthmoving machine 100.

Position detection apparatus 20 has an antenna 21, a global coordinate operation portion 23, and an inertial measurement unit (IMU) 24.

Antenna 21 is, for example, an antenna for global navigation satellite systems (GNSS). Antenna 21 is, for example, an antenna for real time kinematic-global navigation satellite systems (RTK-GNSS).

Antenna 21 is provided in revolving unit 3. In the present example, antenna 21 is provided in handrail 19 of revolving unit 3. Antenna 21 may be provided in the rear of engine compartment 9. For example, antenna 21 may be provided in a counterweight of revolving unit 3. Antenna 21 outputs a signal in accordance with a received radio wave (a GNSS radio wave) to global coordinate operation portion 23.

Global coordinate operation portion 23 detects an installation position P1 of antenna 21 in a global coordinate system. The global coordinate system is a three-dimensional coordinate system (Xg, Yg, Zg) based on a reference position Pr installed in an area of working. In the present example, reference position Pr is a position of a tip end of a reference marker set in the area of working. A local coordinate system is a three-dimensional coordinate system expressed by (X, Y, Z) with earthmoving machine 100 being defined as the reference. A reference position in the local coordinate system is data representing a reference position P2 located at an axis of revolution (center of revolution) AX of revolving unit 3.

In the present example, antenna 21 has a first antenna 21A and a second antenna 21B provided in revolving unit 3 as being distant from each other in a direction of a width of the vehicle.

Global coordinate operation portion 23 detects an installation position P1*a* of first antenna 21A and an installation position P1*b* of second antenna 21B. Global coordinate operation portion 23 obtains reference position data P expressed by a global coordinate. In the present example, reference position data P is data representing reference position P2 located at axis of revolution (center of revolution) AX of revolving unit 3. Reference position data P may be data representing installation position P1.

In the present example, global coordinate operation portion 23 generates revolving unit orientation data Q based on two installation positions P1*a* and P1*b*. Revolving unit orientation data Q is determined based on an angle formed by a straight line determined by installation position P1*a* and installation position P1*b* with respect to a reference azimuth (for example, north) of the global coordinate. Revolving unit orientation data Q represents an orientation in which revolving unit 3 (work implement 2) is oriented. Global coordinate operation portion 23 outputs reference position data P and revolving unit orientation data Q to a display controller 28 which will be described later.

IMU 24 is provided in revolving unit 3. In the present example, IMU 24 is arranged in a lower portion of operator's cab 4. In revolving unit 3, a highly rigid frame is arranged in the lower portion of operator's cab 4. IMU 24 is arranged on that frame. IMU 24 may be arranged lateral to (on the right or left of) axis of revolution AX (reference position P2) of revolving unit 3. IMU 24 detects an angle of inclination θ4 representing inclination in the lateral direction of main body 1 and an angle of inclination θ5 representing inclination in the fore/aft direction of main body 1.

<Configuration of Control System>

Figure 3:
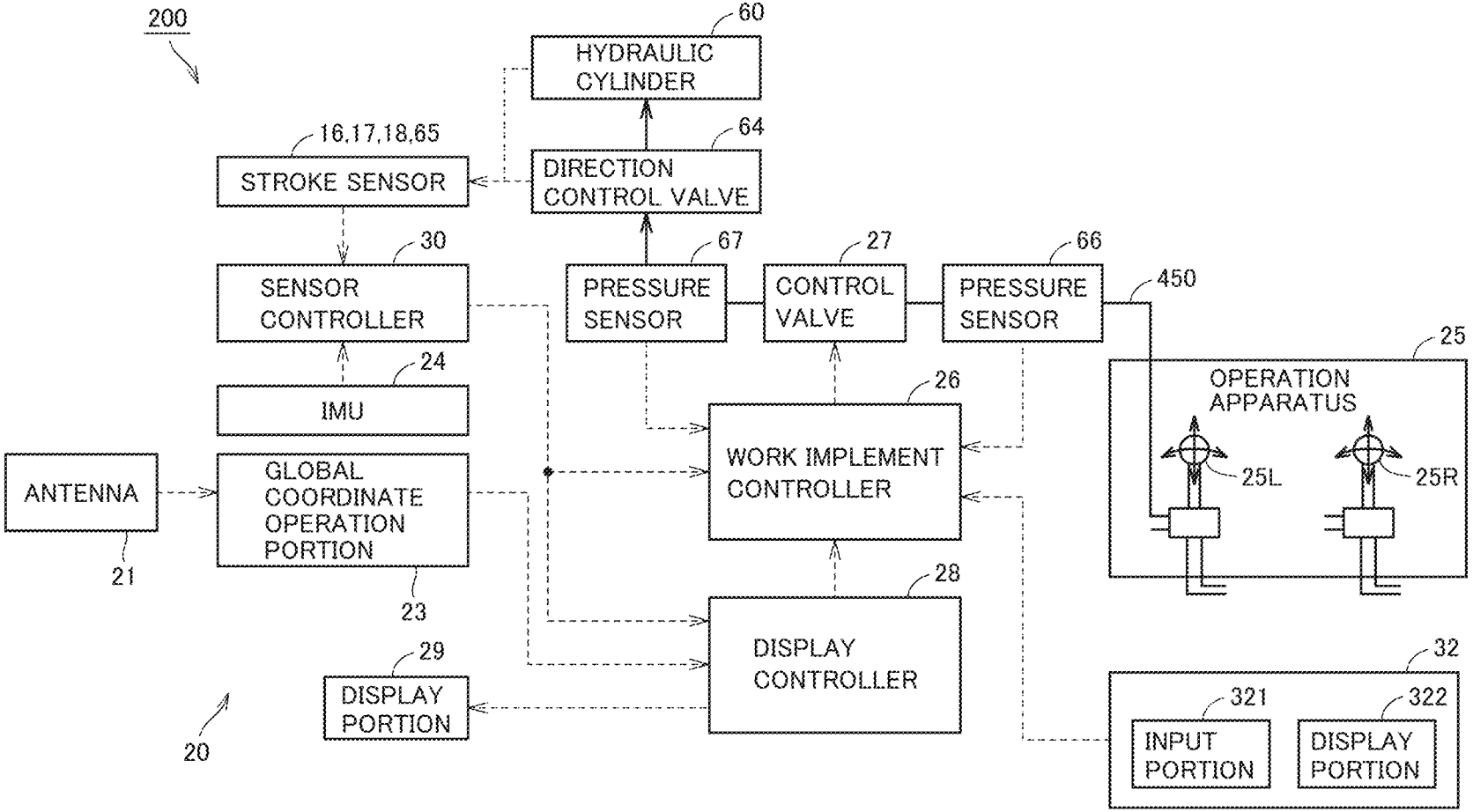
FIG. 3 is a functional block diagram showing a configuration of a control system based on the embodiment.

Overview of a control system 200 based on the embodiment will now be described. FIG. 3 is a functional block diagram showing a configuration of control system 200 based on the embodiment.

Control system 200 is mounted on earthmoving machine 100. As shown in FIG. 3, control system 200 controls processing for excavation with work implement 2. In the present example, control for excavation processing has land grading control.

Land grading control means automatic control of land grading work in which soil abutting to bucket 8 is plowed and leveled by movement of bucket 8 along design topography and a surface corresponding to flat design topography is made, and it is also referred to as excavation limit control.

Land grading control is carried out when the arm is operated by an operator and a distance between the cutting edge of the bucket and design topography and a speed of the cutting edge are within the reference. During land grading control, normally, the operator operates the arm so as to perform an operation of arm 7 in any one of such an excavation direction that arm 7 comes closer to main body 1 and such a dumping direction that arm 7 moves away from main body 1.

Control system 200 has boom cylinder stroke sensor 16, arm cylinder stroke sensor 17, bucket cylinder stroke sensor 18, antenna 21, global coordinate operation portion 23, IMU 24, an operation apparatus 25, a work implement controller 26, a pressure sensor 66 and a pressure sensor 67, a control valve 27, a direction control valve 64, display controller 28, a display portion 29, a sensor controller 30, and a man-machine interface portion 32.

Operation apparatus 25 is arranged in operator's cab 4. The operator operates operation apparatus 25. Operation apparatus 25 accepts an operation by the operator for driving work implement 2. More specifically, operation apparatus 25 accepts operations by the operator for operating boom cylinder 10, arm cylinder 11, and bucket cylinder 12. Operation apparatus 25 outputs an operation signal in accordance with an operation by the operator. In the present example, operation apparatus 25 is an operation apparatus of a pilot hydraulic type.

Direction control valve 64 regulates an amount of supply of a hydraulic oil to a hydraulic cylinder. Direction control valve 64 operates with an oil supplied to a first pressure reception chamber and a second pressure reception chamber. In the present example, an oil supplied to the hydraulic cylinder (boom cylinder 10, arm cylinder 11, and bucket cylinder 12) in order to operate the hydraulic cylinder is also referred to as a hydraulic oil. An oil supplied to direction control valve 64 for operating direction control valve 64 is also referred to as a pilot oil. A pressure of the pilot oil is also referred to as a pilot oil pressure.

The hydraulic oil and the pilot oil may be delivered from the same hydraulic pump. For example, a pressure of some of the hydraulic oil delivered from the hydraulic pump may be reduced by a pressure reduction valve and the hydraulic oil of which pressure has been reduced may be used as the pilot oil. A hydraulic pump delivering a hydraulic oil (a main hydraulic pump) and a hydraulic pump delivering a pilot oil (a pilot hydraulic pump) may be different from each other.

Operation apparatus 25 has a first control lever 25R and a second control lever 25L. First control lever 25R is arranged, for example, on the right side of operator's seat 4S. Second control lever 25L is arranged, for example, on the left side of operator's seat 4S. Operations of first control lever 25R and second control lever 25L in fore, aft, left, and right directions correspond to operations along two axes.

Boom 6 and bucket 8 are operated with the use of first control lever 25R. An operation of first control lever 25R in the fore/aft direction corresponds to the operation of boom 6, and an operation for lowering boom 6 and an operation for raising boom 6 are performed in response to the operation in the fore/aft direction. An operation of first control lever 25R in the lateral direction corresponds to the operation of bucket 8, and an excavation operation and a dumping operation by bucket 8 are performed in response to an operation in the lateral direction.

Arm 7 and revolving unit 3 are operated with the use of second control lever 25L. An operation of second control lever 25L in the fore/aft direction corresponds to the operation of arm 7, and an operation for raising arm 7 and an operation for lowering arm 7 are performed in response to the operation in the fore/aft direction. An operation of second control lever 25L in the lateral direction corresponds to revolution of revolving unit 3, and an operation for revolving revolving unit 3 to the right and an operation for revolving revolving unit 3 to the left are performed in response to the operation in the lateral direction.

In the present example, operations for raising and lowering boom 6 are also referred to as a raising operation and a lowering operation, respectively. An operation of arm 7 in a vertical direction is also referred to as a dumping operation and an excavation operation. An operation of bucket 8 in the vertical direction is also referred to as a dumping operation and an excavation operation.

A pilot oil delivered from the main hydraulic pump, of which pressure has been reduced by the pressure reduction valve, is supplied to operation apparatus 25. The pilot oil pressure is regulated based on an amount of operation of operation apparatus 25.

Pressure sensor 66 and pressure sensor 67 are arranged in a pilot oil path 450. Pressure sensor 66 and pressure sensor 67 detect a pilot oil pressure. A result of detection by pressure sensor 66 and pressure sensor 67 is output to work implement controller 26.

First control lever 25R is operated in the fore/aft direction for driving boom 6. Direction control valve 64 regulates a direction of flow and a flow rate of the hydraulic oil supplied to boom cylinder 10 for driving boom 6, in accordance with an amount of operation of first control lever 25R (an amount of operation of the boom) in the fore/aft direction. First control lever 25R implements a boom control member accepting an operation by an operator for driving boom 6.

First control lever 25R is operated in the lateral direction for driving bucket 8. Direction control valve 64 regulates a direction of flow and a flow rate of the hydraulic oil supplied to bucket cylinder 12 for driving bucket 8, in accordance with an amount of operation of first control lever 25R (an amount of operation of the bucket) in the lateral direction. First control lever 25R implements a bucket control member accepting an operation by an operator for driving bucket 8.

Second control lever 25L is operated in the fore/aft direction for driving arm 7. Direction control valve 64 regulates a direction of flow and a flow rate of the hydraulic oil supplied to arm cylinder 11 for driving arm 7, in accordance with an amount of operation of second control lever 25L (an amount of operation of the arm) in the fore/aft direction. Second control lever 25L implements an arm control member accepting an operation by an operator for driving arm 7.

Second control lever 25L is operated in the lateral direction for driving revolving unit 3. Direction control valve 64 regulates a direction of flow and a flow rate of the hydraulic oil supplied to a hydraulic actuator for driving revolving unit 3, in accordance with an amount of operation of second control lever 25L in the lateral direction. Second control lever 25L implements a revolving unit control member accepting an operation by an operator for driving revolving unit 3.

The operation of first control lever 25R in the lateral direction may correspond to the operation of boom 6 and the operation thereof in the fore/aft direction may correspond to the operation of bucket 8. The fore/aft direction of second control lever 25L may correspond to the operation of revolving unit 3 and the operation in the lateral direction may correspond to the operation of arm 7.

Control valve 27 regulates an amount of supply of the hydraulic oil to the hydraulic cylinder (boom cylinder 10, arm cylinder 11, and bucket cylinder 12). Control valve 27 operates based on a control signal from work implement controller 26.

Man-machine interface portion 32 has an input portion 321 and a display portion (a monitor) 322.

In the present example, input portion 321 has an operation button arranged around display portion 322. Input portion 321 may have a touch panel. Man-machine interface portion 32 is also referred to as a multi-monitor.

Display portion 322 displays an amount of remaining fuel and a coolant temperature as basic information.

Input portion 321 is operated by an operator. A command signal generated in response to an operation of input portion 321 is output to work implement controller 26.

Sensor controller 30 calculates a boom cylinder length based on a result of detection by boom cylinder stroke sensor 16. Boom cylinder stroke sensor 16 outputs pulses associated with a go-around operation to sensor controller 30. Sensor controller 30 calculates a boom cylinder length based on pulses output from boom cylinder stroke sensor 16.

Similarly, sensor controller 30 calculates an arm cylinder length based on a result of detection by arm cylinder stroke sensor 17. Sensor controller 30 calculates a bucket cylinder length based on a result of detection by bucket cylinder stroke sensor 18.

Sensor controller 30 calculates an angle of inclination θ1 of boom 6 with respect to a perpendicular direction of revolving unit 3 from the boom cylinder length obtained based on the result of detection by boom cylinder stroke sensor 16.

Sensor controller 30 calculates an angle of inclination θ2 of arm 7 with respect to boom 6 from the arm cylinder length obtained based on the result of detection by arm cylinder stroke sensor 17.

Sensor controller 30 calculates an angle of inclination θ3*a* of cutting edge 8*a* of bucket 8 with respect to arm 7 and an angle of inclination θ3*b* of rear surface end 8*b* of bucket 8 with respect to arm 7 from the bucket cylinder length obtained based on the result of detection by bucket cylinder stroke sensor 18.

Positions of boom 6, arm 7, and bucket 8 of earthmoving machine 100 can be specified based on angles of inclination θ1, 82, 03*a*, and 03*b* which are results of calculation above, reference position data P, revolving unit orientation data Q, and cylinder length data L, and bucket position data representing a three-dimensional position of bucket 8 can be generated.

Angle of inclination θ1 of boom 6, angle of inclination θ2 of arm 7, and angles of inclination θ3*a* and θ3*b* of bucket 8 do not have to be detected by the cylinder stroke sensor. An angle detector such as a rotary encoder may detect angle of inclination θ1 of boom 6. The angle detector detects angle of inclination θ1 by detecting an angle of bending of boom 6 with respect to revolving unit 3. Similarly, an angle detector attached to arm 7 may detect angle of inclination θ2 of arm 7. An angle detector attached to bucket 8 may detect angles of inclination θ3*a* and θ3*b* of bucket 8.

<Configuration of Hydraulic Circuit>

Figure 4:
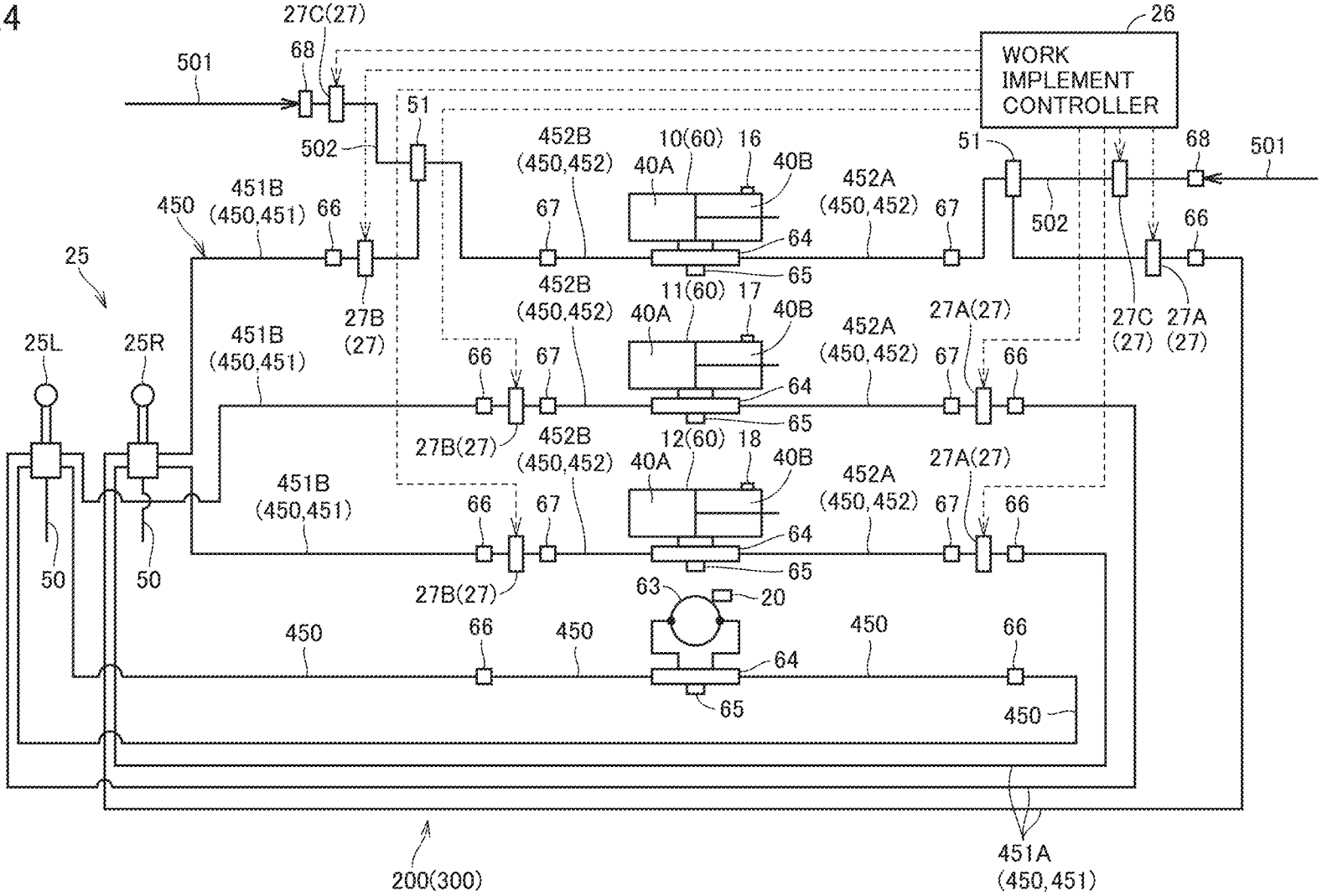
FIG. 4 is a diagram showing a configuration of a hydraulic system based on the embodiment.

FIG. 4 is a diagram showing a configuration of a hydraulic system based on the embodiment.

As shown in FIG. 4, a hydraulic system 300 includes boom cylinder 10, arm cylinder 11, and bucket cylinder 12 (a plurality of hydraulic cylinders 60) as well as a revolution motor 63 revolving revolving unit 3. Here, boom cylinder 10 is also denoted as hydraulic cylinder 10 (60), which is also applicable to other hydraulic cylinders.

Hydraulic cylinder 60 operates with a hydraulic oil supplied from a not-shown main hydraulic pump. Revolution motor 63 is a hydraulic motor and operates with the hydraulic oil supplied from the main hydraulic pump.

In the present example, direction control valve 64 controlling a direction of flow and a flow rate of the hydraulic oil is provided for each hydraulic cylinder 60. The hydraulic oil supplied from the main hydraulic pump is supplied to each hydraulic cylinder 60 through direction control valve 64. Direction control valve 64 is provided for revolution motor 63.

Each hydraulic cylinder 60 has a bottom side oil chamber 40A and a head side oil chamber 40B.

Direction control valve 64 is of a spool type in which a direction of flow of the hydraulic oil is switched by moving a rod-shaped spool. As the spool axially moves, switching between supply of the hydraulic oil to bottom side oil chamber 40A and supply of the hydraulic oil to head side oil chamber 40B is made. As the spool axially moves, an amount of supply of the hydraulic oil to hydraulic cylinder 60 (an amount of supply per unit time) is regulated. As an amount of supply of the hydraulic oil to hydraulic cylinder 60 is regulated, a cylinder speed is adjusted. By adjusting the cylinder speed, speeds of boom 6, arm 7, and bucket 8 are controlled. Direction control valve 64 functions as a regulator capable of regulating an amount of supply of the hydraulic oil to hydraulic cylinder 60 driving work implement 2 as the spool moves.

Each direction control valve 64 is provided with a spool stroke sensor 65 detecting a distance of movement of the spool (a spool stroke). A detection signal from spool stroke sensor 65 is output to sensor controller 30 (FIG. 3).

Drive of each direction control valve 64 is adjusted through operation apparatus 25. The pilot oil delivered from the main hydraulic pump, of which pressure has been reduced by the pressure reduction valve, is supplied to operation apparatus 25 through a pump flow path 50.

Operation apparatus 25 has a pilot oil pressure regulation valve. The pilot oil pressure is regulated based on an amount of operation of operation apparatus 25. The pilot oil pressure drives direction control valve 64. As operation apparatus 25 regulates a pilot oil pressure, an amount of movement and a moving speed of the spool in the axial direction are adjusted. Operation apparatus 25 switches between supply of the hydraulic oil to bottom side oil chamber 40A and supply of the hydraulic oil to head side oil chamber 40B.

Operation apparatus 25 and each direction control valve 64 are connected to each other through pilot oil path 450. In the present example, control valve 27, pressure sensor 66, and pressure sensor 67 are arranged in pilot oil path 450.

Pressure sensor 66 and pressure sensor 67 detecting the pilot oil pressure are provided on opposing sides of each control valve 27, respectively. In the present example, pressure sensor 66 is arranged in an oil path 451 between operation apparatus 25 and control valve 27. Pressure sensor 67 is arranged in an oil path 452 between control valve 27 and direction control valve 64. Pressure sensor 66 detects a pilot oil pressure before regulation by control valve 27. Pressure sensor 67 detects a pilot oil pressure regulated by control valve 27. Results of detection by pressure sensor 66 and pressure sensor 67 are output to work implement controller 26.

Control valve 27 regulates a pilot oil pressure based on a control signal (an EPC current) from work implement controller 26. Control valve 27 is an electromagnetic proportional control valve and is controlled based on a control signal from work implement controller 26. Control valve 27 has a control valve 27B and a control valve 27A. Control valve 27B regulates a pilot oil pressure of the pilot oil supplied to the second pressure reception chamber of direction control valve 64, so as to be able to regulate an amount of supply of the hydraulic oil supplied to bottom side oil chamber 40A through direction control valve 64. Control valve 27A regulates a pilot oil pressure of the pilot oil supplied to the first pressure reception chamber of direction control valve 64, so as to be able to regulate an amount of supply of the hydraulic oil supplied to head side oil chamber 40B through direction control valve 64.

In the present example, pilot oil path 450 between operation apparatus 25 and control valve 27 of pilot oil path 450 is referred to as oil path (an upstream oil path) 451. Pilot oil path 450 between control valve 27 and direction control valve 64 is referred to as oil path (a downstream oil path) 452.

The pilot oil is supplied to each direction control valve 64 through oil path 452.

Oil path 452 has an oil path 452A connected to the first pressure reception chamber and an oil path 452B connected to the second pressure reception chamber.

When the pilot oil is supplied through oil path 452B to the second pressure reception chamber of direction control valve 64, the spool moves in accordance with the pilot oil pressure. The hydraulic oil is supplied to bottom side oil chamber 40A through direction control valve 64. An amount of supply of the hydraulic oil to bottom side oil chamber 40A is regulated based on an amount of movement of the spool in accordance with the amount of operation of operation apparatus 25.

When the pilot oil is supplied through oil path 452A to the first pressure reception chamber of direction control valve 64, the spool moves in accordance with the pilot oil pressure. The hydraulic oil is supplied to head side oil chamber 40B through direction control valve 64. An amount of supply of the hydraulic oil to head side oil chamber 40B is regulated based on an amount of movement of the spool in accordance with the amount of operation of operation apparatus 25.

Therefore, as the pilot oil of which pressure is regulated through operation apparatus 25 and control valve 27 is supplied to direction control valve 64, a position of the spool in the axial direction is adjusted.

Oil path 451 has an oil path 451A connecting oil path 452A and operation apparatus 25 to each other and an oil path 451B connecting oil path 452B and operation apparatus 25 to each other.

[As to Operation of Operation Apparatus 25 and Operation of Hydraulic System]

As described above, as operation apparatus 25 is operated, boom 6 performs two types of operations of a lowering operation and a raising operation.

As operation apparatus 25 is operated to perform the operation for raising boom 6, the pilot oil is supplied to oil path 451B. Control valve 27B regulates a pressure of the pilot oil supplied to oil path 452B based on an operation by the operator for operating boom cylinder 10 in a direction to increase a boom cylinder length. The pilot oil which has passed through control valve 27B is supplied to direction control valve 64 which controls an operation of boom cylinder 10 through oil path 452B.

Thus, the hydraulic oil from the main hydraulic pump is supplied to bottom side oil chamber 40A of boom cylinder 10 and the operation for raising boom 6 is performed.

As operation apparatus 25 is operated to perform the operation for lowering boom 6, the pilot oil is supplied to oil path 451A. Control valve 27A regulates a pressure of the pilot oil supplied to oil path 452A based on an operation by the operator for operating boom cylinder 10 in a direction to decrease a boom cylinder length. The pilot oil which has passed through control valve 27A is supplied to direction control valve 64 which controls an operation of boom cylinder 10 through oil path 452A.

Thus, the hydraulic oil from the main hydraulic pump is supplied to head side oil chamber 49B of boom cylinder 10 and the operation for lowering boom 6 is performed.

In the present example, as boom cylinder 10 extends, boom 6 performs the raising operation, and as boom cylinder 10 contracts, boom 6 performs the lowering operation. As the hydraulic oil is supplied to bottom side oil chamber 40A of boom cylinder 10, boom cylinder 10 extends and boom 6 performs the raising operation. As the hydraulic oil is supplied to head side oil chamber 40B of boom cylinder 10, boom cylinder 10 contracts and boom 6 performs the lowering operation.

As operation apparatus 25 is operated, arm 7 performs two types of operations of an excavation operation and a dumping operation.

As operation apparatus 25 is operated to perform the operation for excavation by arm 7, the pilot oil is supplied through oil path 451B and oil path 452B to direction control valve 64 which controls an operation of arm cylinder 11.

Thus, the hydraulic oil from the main hydraulic pump is supplied to arm cylinder 11 and the operation for excavation by arm 7 is performed.

As operation apparatus 25 is operated to perform the operation for dumping by arm 7, the pilot oil is supplied through oil path 451A and oil path 452A to direction control valve 64 which controls an operation of arm cylinder 11.

Thus, the hydraulic oil from the main hydraulic pump is supplied to arm cylinder 11 and the operation for dumping by arm 7 is performed.

In the present example, as arm cylinder 11 extends, arm 7 performs the lowering operation (excavation operation), and as arm cylinder 11 contracts, arm 7 performs the raising operation (dumping operation). As the hydraulic oil is supplied to bottom side oil chamber 40A of arm cylinder 11, arm cylinder 11 extends and arm 7 performs the lowering operation. As the hydraulic oil is supplied to head side oil chamber 40B of arm cylinder 11, arm cylinder 11 contracts and arm 7 performs the raising operation.

As operation apparatus 25 is operated, bucket 8 performs two types of operations of an excavation operation and a dumping operation.

As operation apparatus 25 is operated to perform the operation for excavation by bucket 8, the pilot oil is supplied through oil path 451B and oil path 452B to direction control valve 64 which controls an operation of bucket cylinder 12.

Thus, the hydraulic oil from the main hydraulic pump is supplied to bucket cylinder 12 and the operation for excavation by bucket 8 is performed.

As operation apparatus 25 is operated to perform the operation for dumping by bucket 8, the pilot oil is supplied through oil path 451A and oil path 452A to direction control valve 64 which controls an operation of bucket cylinder 12.

Thus, the hydraulic oil from the main hydraulic pump is supplied to bucket cylinder 12 and the operation for dumping by bucket 8 is performed.

In the present example, as bucket cylinder 12 extends, bucket 8 performs the lowering operation (excavation operation), and as bucket cylinder 12 contracts, bucket 8 performs the raising operation (dumping operation). As the hydraulic oil is supplied to bottom side oil chamber 40A of bucket cylinder 12, bucket cylinder 12 extends and bucket 8 performs the lowering operation. As the hydraulic oil is supplied to head side oil chamber 40B of bucket cylinder 12, bucket cylinder 12 contracts and bucket 8 performs the raising operation.

As operation apparatus 25 is operated, revolving unit 3 performs two types of operations of an operation for revolving to the right and an operation for revolving to the left.

As operation apparatus 25 is operated to perform the operation for revolving unit 3 to revolve to the right, the hydraulic oil is supplied to revolution motor 63. As operation apparatus 25 is operated to perform the operation for revolving unit 3 to revolve to the left, the hydraulic oil is supplied to revolution motor 63.

[As to Normal Control and Land Grading Control (Excavation Limit Control) and Operation of Hydraulic System]

Normal control in which no land grading control (excavation limit control) is carried out will be described.

In the case of normal control, work implement 2 operates in accordance with an amount of operation of operation apparatus 25.

Specifically, work implement controller 26 causes control valve 27 to open. By opening control valve 27, the pilot oil pressure of oil path 451 and the pilot oil pressure of oil path 452 are equal to each other. While control valve 27 is open, the pilot oil pressure (a PPC pressure) is regulated based on the amount of operation of operation apparatus 25. Thus, direction control valve 64 is regulated, and the operation for raising and lowering boom 6, arm 7, and bucket 8 described above can be performed.

On the other hand, land grading control (excavation limit control) will be described.

In the case of land grading control (excavation limit control), work implement 2 is controlled by work implement controller 26 based on an operation of operation apparatus 25.

Specifically, work implement controller 26 outputs a control signal to control valve 27. Oil path 451 has a prescribed pressure, for example, owing to an action of a pilot oil pressure regulation valve.

Control valve 27 operates based on a control signal from work implement controller 26. The pilot oil in oil path 451 is supplied to oil path 452 through control valve 27. Therefore, a pressure of the pilot oil in oil path 452 can be regulated (reduced) by means of control valve 27.

A pressure of the pilot oil in oil path 452 is applied to direction control valve 64. Thus, direction control valve 64 operates based on the pilot oil pressure controlled by control valve 27.

For example, work implement controller 26 can regulate a pilot oil pressure applied to direction control valve 64 which controls an operation of arm cylinder 11 by outputting a control signal to at least one of control valve 27A and control valve 27B. As the pilot oil of which pressure is regulated by control valve 27A is supplied to direction control valve 64, the spool axially moves toward one side. As the pilot oil of which pressure is regulated by control valve 27B is supplied to direction control valve 64, the spool axially moves toward the other side. Thus, a position of the spool in the axial direction is adjusted.

Control valve 27B regulating a pressure of a pilot oil supplied to direction control valve 64 which controls an operation of arm cylinder 11 implements a proportional solenoid valve for arm excavation.

Similarly, work implement controller 26 can regulate a pilot oil pressure applied to direction control valve 64 which controls an operation of bucket cylinder 12 by outputting a control signal to at least one of control valve 27A and control valve 27B.

Similarly, work implement controller 26 can regulate a pilot oil pressure applied to direction control valve 64 which controls an operation of boom cylinder 10 by outputting a control signal to at least one of control valve 27A and control valve 27B.

Furthermore, work implement controller 26 can regulate a pilot oil pressure applied to direction control valve 64 which controls an operation of boom cylinder 10 by outputting a control signal to a control valve 27C.

Figure 5:
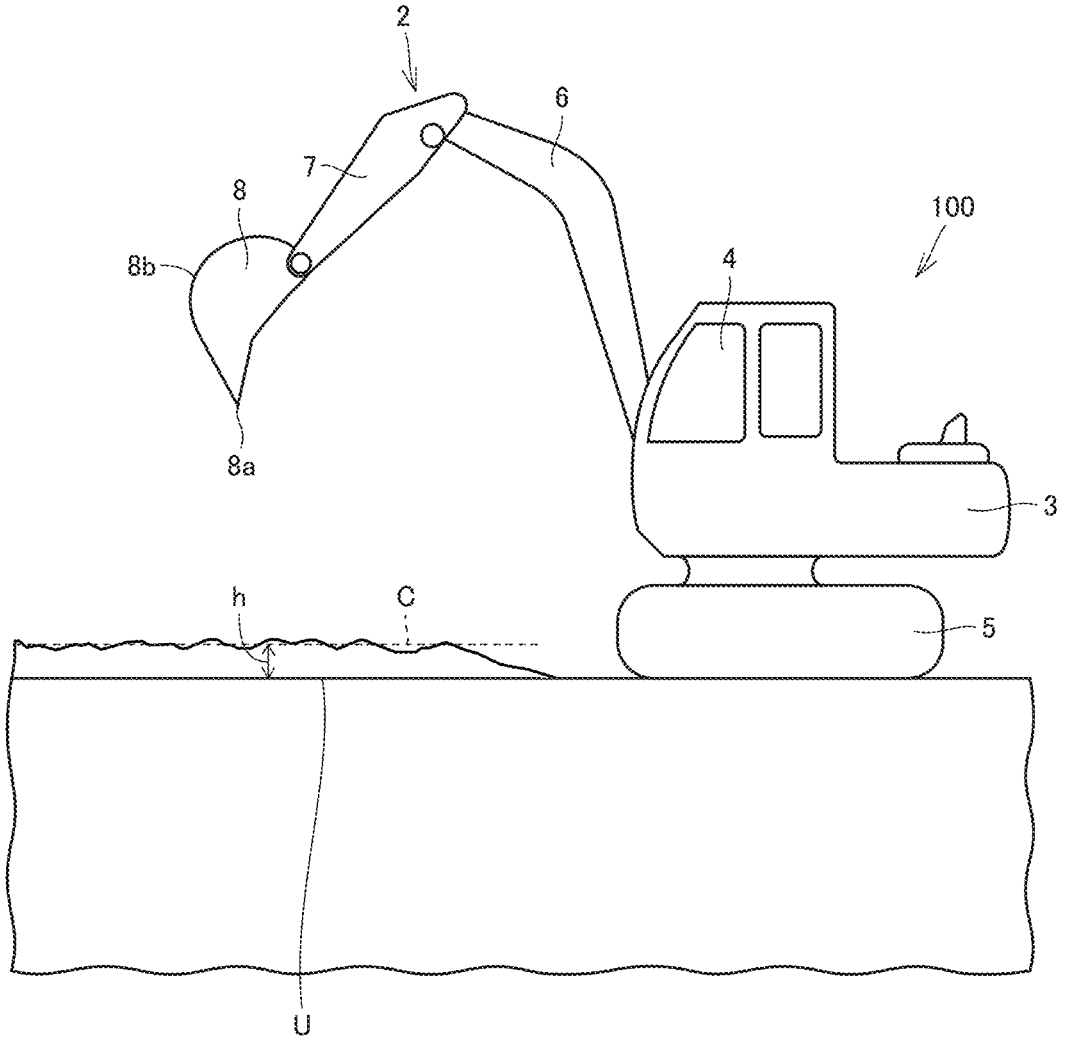
FIG. 5 is a cross-sectional view of design topography.

Thus, work implement controller 26 controls movement of boom 6 (intervention control) such that a monitoring point in bucket 8, that is, any one of cutting edge 8*a* and rear surface end 8*b*, moves along design topography U (FIG. 5).

In the present example, control of a position of boom 6 by outputting a control signal to control valve 27 connected to boom cylinder 10 such that entry of the monitoring point (cutting edge 8*a* or rear surface end 8*b*) in bucket 8 into design topography U is suppressed is referred to as boom raising intervention control.

Specifically, work implement controller 26 controls a speed of boom 6 such that a speed at which bucket 8 comes closer to design topography U decreases in accordance with a first distance d1 (FIG. 6) which is a distance between design topography U and cutting edge 8*a* or a second distance d2 (FIG. 7) which is a distance between design topography U and rear surface end 8*b*, based on design topography U representing an aimed shape of an excavation target and data representing a position of bucket 8.

In the present example, control of a position of boom 6 by outputting a control signal to control valve 27 connected to boom cylinder 10 such that movement of the monitoring point (cutting edge 8*a* or rear surface end 8*b*) in bucket 8 away from design topography U is suppressed is referred to as boom lowering intervention control.

Specifically, work implement controller 26 controls a speed of boom 6 such that a speed at which bucket 8 moves away from design topography U decreases in accordance with first distance d1 or second distance d2, based on design topography U and data representing a position of bucket 8.

Hydraulic system 300 has oil paths 501 and 502, control valve 27C, a shuttle valve 51, and a pressure sensor 68, as a mechanism for intervention control of the operation of boom 6 based on an operation of operation apparatus 25.

Oil paths 501 and 502 are connected to control valve 27C and serve to supply a pilot oil to be supplied to direction control valve 64 which controls an operation of boom cylinder 10. Oil path 501 is connected to control valve 27C and a not-shown main hydraulic pump. Oil path 501 may be branched from pump flow path 50. Alternatively, oil path 501 may be provided as an oil path through which the pilot oil delivered from the main hydraulic pump, of which pressure has been reduced by the pressure reduction valve, flows, separately from pump flow path 50.

The pilot oil before passage through control valve 27C flows through oil path 501. The pilot oil after passage through control valve 27C flows through oil path 502. Oil path 502 is connected to control valve 27C and shuttle valve 51, and connected through shuttle valve 51 to oil path 452 (452A, 452B) connected to direction control valve 64.

Pressure sensor 68 detects a pilot oil pressure of the pilot oil in oil path 501.

A pilot oil higher in pressure than the pilot oil which flows through control valves 27A and 27B flows through control valve 27C. Control valve 27C is controlled based on a control signal output from work implement controller 26 for carrying out intervention control.

Shuttle valve 51 has two inlet ports and one outlet port. One inlet port is connected to oil path 502. The other inlet port is connected to control valve 27B through oil path 452B. The outlet port is connected to direction control valve 64 through oil path 452 (452A, 452B). Shuttle valve 51 connects oil path 452 connected to direction control valve 64 to an oil path higher in pilot oil pressure, of oil path 502 and oil path 452 connected to control valve 27.

Shuttle valve 51 is a high pressure priority shuttle valve. Shuttle valve 51 selects a pressure on a high pressure side, based on comparison between the pilot oil pressure of oil path 502 connected to one of the inlet ports and the pilot oil pressure of oil path 452 on the side of control valve 27 connected to the other of the inlet ports. Shuttle valve 51 communicates a flow path on the high pressure side, of oil path 502 and oil path 452 on the side of control valve 27 to the outlet port, and allows supply of the pilot oil which flows through the flow path on the high pressure side to direction control valve 64.

In the present example, work implement controller 26 outputs a control signal so as to fully open control valves 27A and 27B such that direction control valve 64 is driven based on the pilot oil pressure regulated in response to the operation of operation apparatus 25 and so as to close control valve 27C such that the pilot oil is not supplied to direction control valve 64 through oil path 501 while intervention control is not carried out.

Alternatively, work implement controller 26 outputs a control signal to each control valve 27 such that direction control valve 64 is driven based on the pilot oil pressure regulated by control valve 27 while intervention control is carried out.

When intervention control restricting movement of boom 6 is carried out, work implement controller 26 controls control valve 27C to open more such that the pilot oil at a pressure higher than the pilot oil pressure regulated by using operation apparatus 25 flows through control valve 27C to oil path 502. Thus, the pilot oil at a high pressure which flows through control valve 27C is supplied to direction control valve 64 through shuttle valve 51.

Oil paths 501 and 502 connected to one of the inlet ports of shuttle valve 51 and oil paths 451 and 452 connected to the other of the inlet ports are all oil paths for operating boom 6. More specifically, oil paths 451 and 452 function as oil paths for a normal operation of boom 6, and oil paths 501 and 502 function as oil paths for a forced operation to forcibly operate boom 6. Control valve 27A can be expressed as a proportional solenoid valve for normal lowering of the boom, control valve 27B can be expressed as a proportional solenoid valve for normal raising of the boom, and control valve 27C can be expressed as a proportional solenoid valve for forced raising of the boom or a proportional solenoid valve for forced lowering of the boom.

<Design Topography U and Monitoring Point in Bucket 8>

FIG. 5 is a cross-sectional view of design topography and a schematic diagram showing one example of the design topography shown on display portion 322 (FIG. 3).

Design topography U shown in FIG. 5 is a flat surface. An operator carries out excavation along design topography U by moving bucket 8 along design topography U.

An intervention line C shown in FIG. 5 demarcates a region where intervention control is to be carried out. When a monitoring point (cutting edge 8*a* or rear surface end 8*b*) in bucket 8 is present on a side closer to design topography U relative to intervention line C, intervention control by control system 200 is carried out. Intervention line C is set at a position distant by a line distance h from design topography U. When a distance between the monitoring point in bucket 8 and design topography U is equal to or smaller than line distance h, intervention control is carried out.

Figure 6:
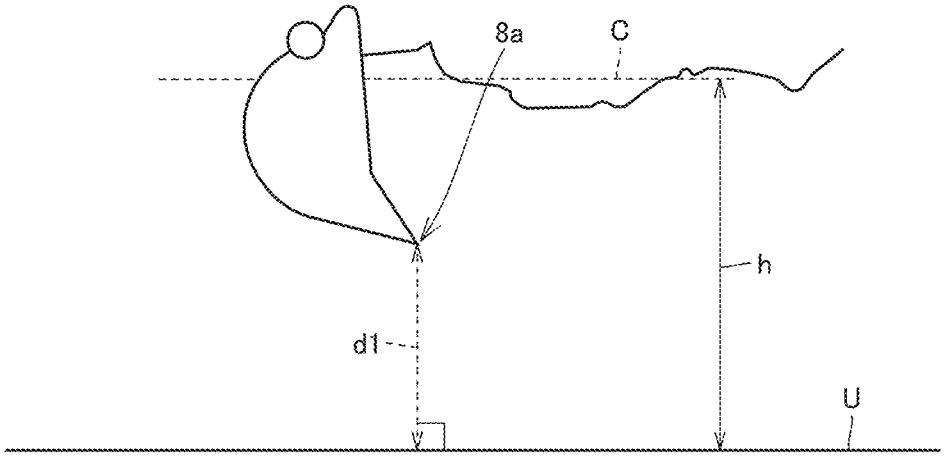
FIG. 6 is a schematic diagram showing positional relation between a cutting edge and design topography.

FIG. 6 is a schematic diagram showing positional relation between cutting edge 8*a* and design topography U. As shown in FIG. 6, a distance between cutting edge 8*a* and design topography U in a direction perpendicular to design topography U is defined as a first distance d1. First distance d1 is a distance shortest between cutting edge 8*a* of bucket 8 and a surface of design topography U.

Figure 7:
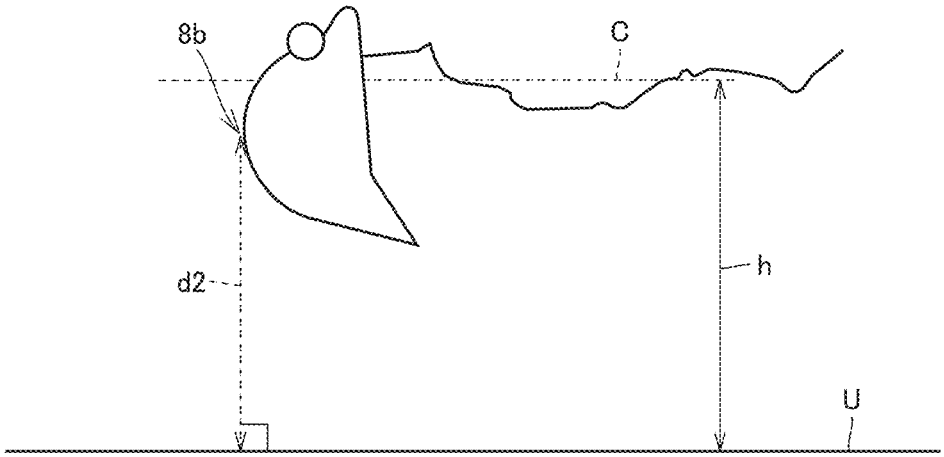
FIG. 7 is a schematic diagram showing positional relation between a rear surface end and design topography.

FIG. 7 is a schematic diagram showing positional relation between rear surface end 8*b* and design topography U. FIGS. 6 and 7 show a position of bucket 8 at the same time point. As shown in FIG. 7, a distance between rear surface end 8*b* and design topography U in the direction perpendicular to design topography U is defined as a second distance d2. Second distance d2 is a distance shortest between rear surface end 8*b* of bucket 8 and the surface of design topography U.

Figure 8:
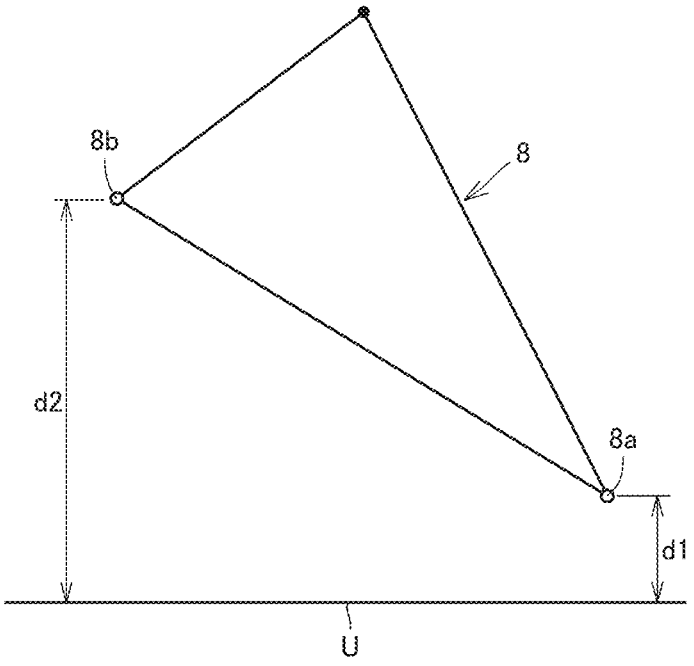
FIG. 8 is a first diagram showing selection of a monitoring point based on an attitude of a bucket.

FIG. 8 is a first diagram showing selection of a monitoring point based on an attitude of bucket 8. A black circle shown in FIGS. 8 and 9 indicates a position of bucket pin 15 (FIGS. 1 and 2). One of white circles indicates cutting edge 8*a* of bucket 8 and the other thereof indicates rear surface end 8*b*. In bucket 8 shown in FIG. 8, first distance d1 is smaller than second distance d2. In this case, cutting edge 8*a* smaller in distance from design topography U is defined as a monitoring point to be used as a control point in land grading control.

Figure 9:
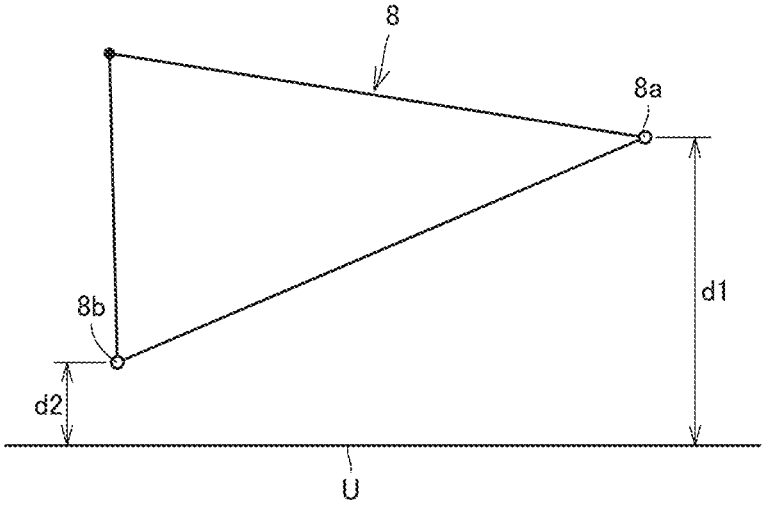
FIG. 9 is a second diagram showing selection of a monitoring point based on an attitude of the bucket.

FIG. 9 is a second diagram showing selection of a monitoring point based on an attitude of bucket 8. In bucket 8 shown in FIG. 9, second distance d2 is smaller than first distance d1. In this case, rear surface end 8*b* smaller in distance from design topography U is defined as a monitoring point to be used as a control point in land grading control.

<Land Grading Control Before Application of Present Invention>

Figure 10:
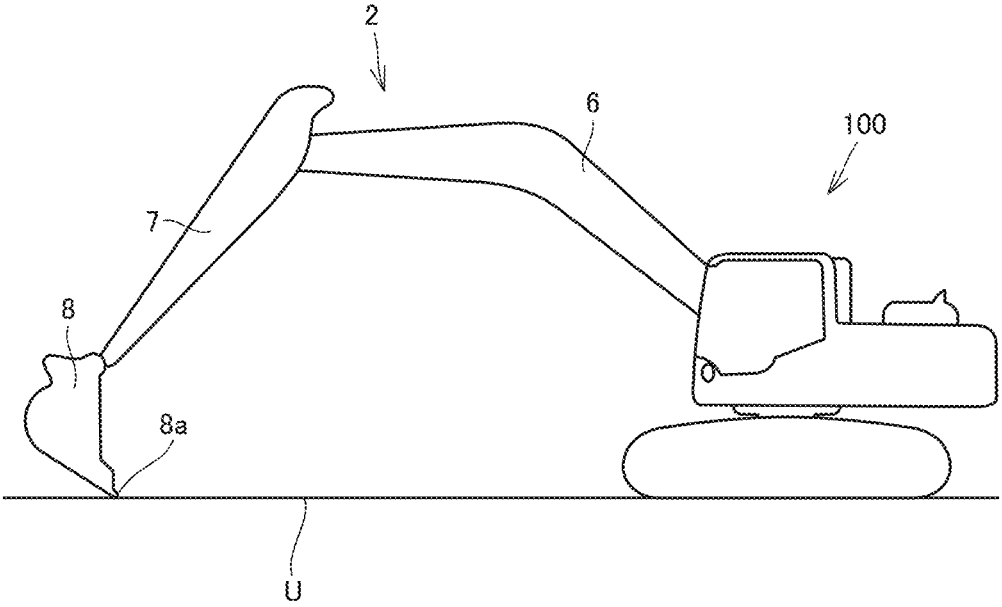
FIG. 10 is a first diagram schematically showing an operation of a work implement when land grading control is carried out before application of the present invention.
Figure 11:
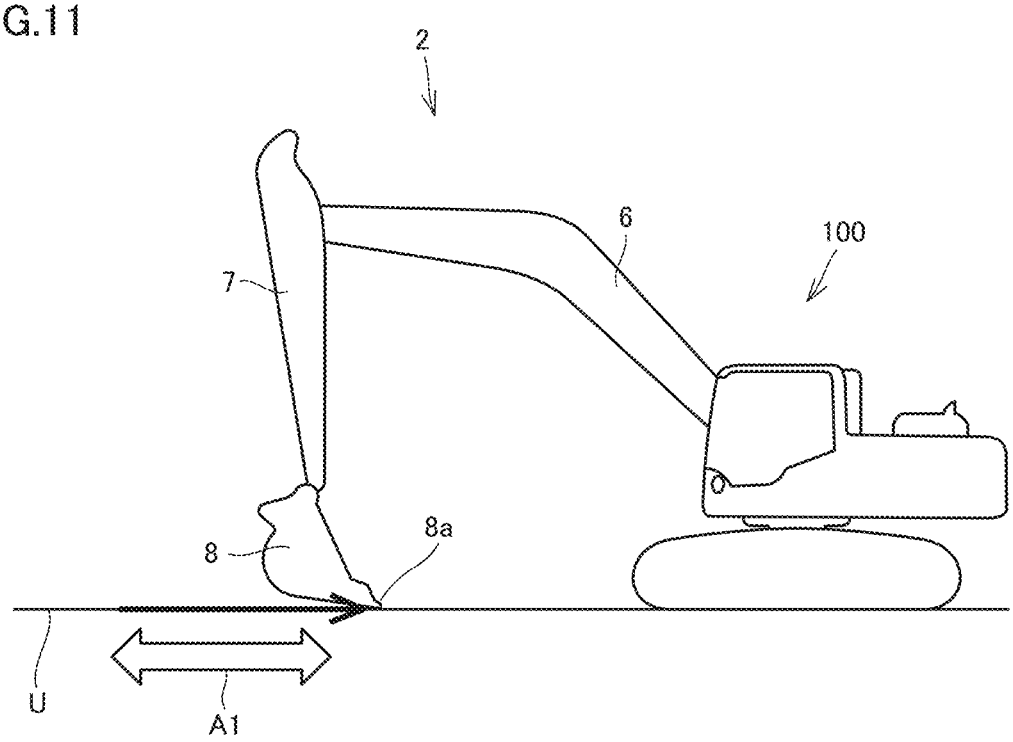
FIG. 11 is a second diagram schematically showing an operation of the work implement when land grading control is carried out before application of the present invention.
Figure 12:
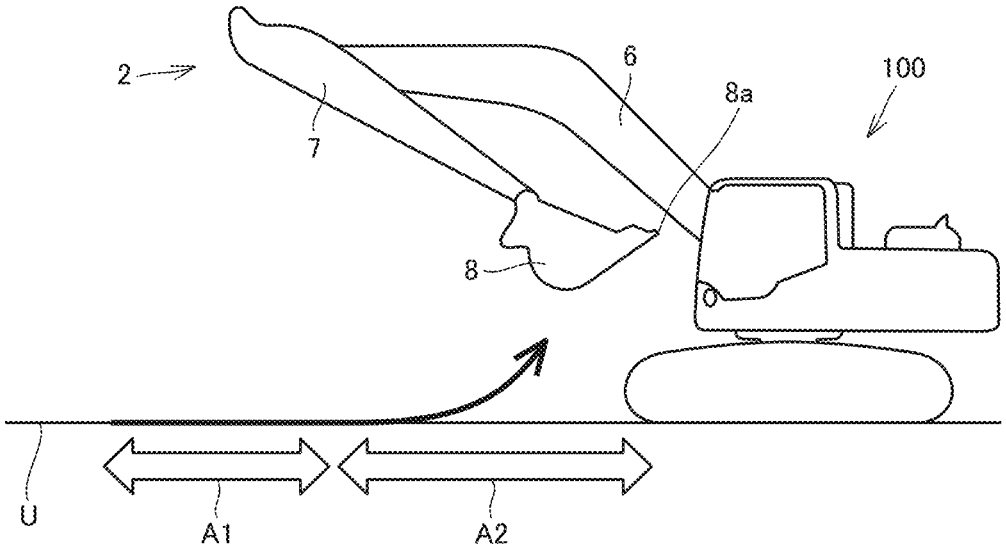
FIG. 12 is a third diagram schematically showing an operation of the work implement when land grading control is carried out before application of the present invention.

FIGS. 10 to 12 are diagrams schematically showing an operation of work implement 2 when land grading control is carried out before application of the present invention.

An operator performs an operation to move arm 7 in a direction of excavation from a state in which cutting edge 8*a* of bucket 8 is in registration with design topography U shown in FIG. 10. Since cutting edge 8*a* of bucket 8 moves as leaving a trace in an arc shape with an operation of arm 7, work implement controller 26 outputs a command to forcibly raise boom 6 and to carry out boom raising intervention control, so as not to cause such a situation that cutting edge 8*a* moves below design topography U and excessively excavates.

Consequently, as shown with an arrow in FIG. 11, cutting edge 8*a* of bucket 8 moves along design topography U and cutting edge 8*a* horizontally levels the ground. In an area A1 shown with a hollow double-headed arrow in FIG. 11, land grading to design topography U is carried out only by an excavation operation by arm 7.

When an operation of arm 7 in a direction of excavation is continued, movement of cutting edge 8*a* of bucket 8 in an arc shape with an operation of arm 7 makes transition from movement downward to movement upward. As shown with an arrow in FIG. 12, cutting edge 8*a* of bucket 8 arcuately moves away from design topography U. Consequently, in an area A2 shown with a hollow double-headed arrow in FIG. 12, land grading to design topography U cannot be done only with boom raising intervention control. Therefore, the operator who operates work implement 2 should perform an excavation operation by arm 7 and an operation to lower boom 6 in order to move cutting edge 8*a* of bucket 8 along design topography U in area A2. The operator has had to operate both of first control lever 25R and second control lever 25L (FIGS. 3 and 4) and operations have been complicated.

<Land Grading Control in Embodiment>

Earthmoving machine 100 in the present embodiment obviates the need for such a complicated operation and allows land grading to design topography U with a simplified operation.

Figure 13:
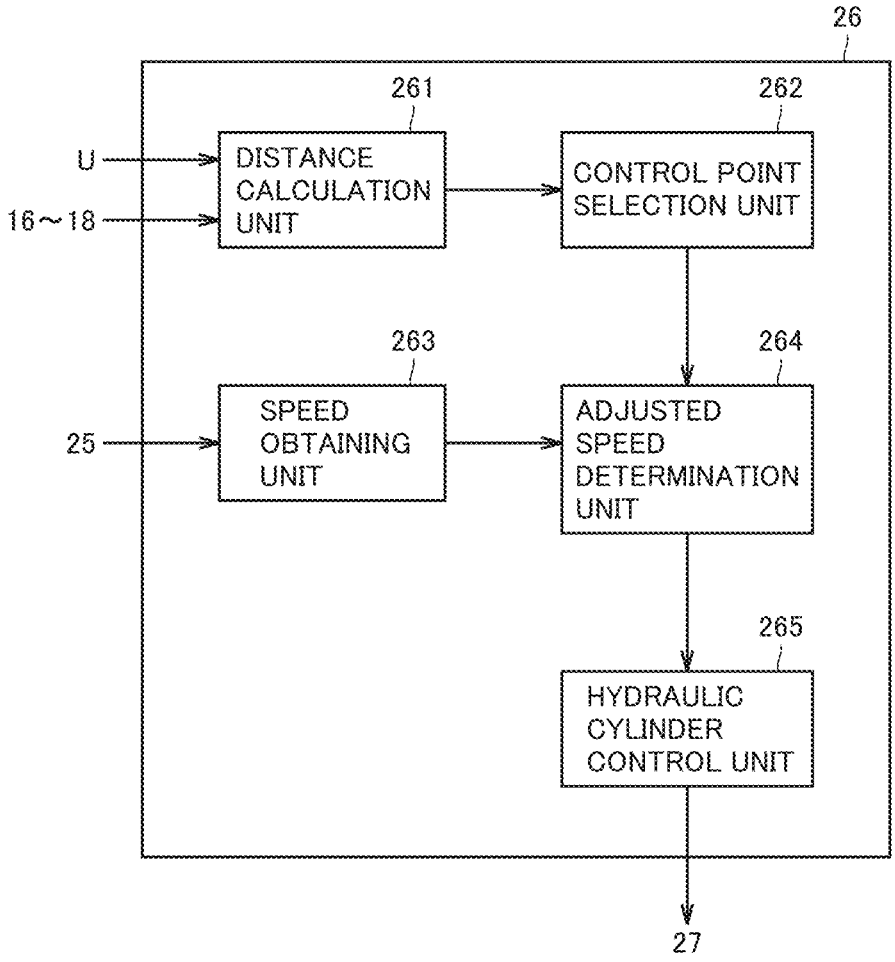
FIG. 13 is a functional block diagram showing a configuration of the control system which carries out land grading control based on the embodiment.

FIG. 13 is a functional block diagram showing a configuration of control system 200 which carries out land grading control based on the embodiment. FIG. 13 shows a functional block of work implement controller 26 of control system 200.

Work implement controller 26 includes a distance calculation unit 261, a control point selection unit 262, a speed obtaining unit 263, an adjusted speed determination unit 264, and a hydraulic cylinder control unit 265 as shown in FIG. 13.

Distance calculation unit 261 calculates first distance d1 between cutting edge 8*a* and design topography U and second distance d2 between rear surface end 8*b* and design topography U. Distance calculation unit 261 calculates first distance d1 and second distance d2 based on design topography U obtained from display controller 28 (FIG. 3) and bucket position data representing a three-dimensional position of bucket 8 which is obtained from cylinder stroke sensors 16 to 18. Distance calculation unit 261 outputs first distance d1 and second distance d2 to control point selection unit 262. Cylinder stroke sensors 16 to 18 for obtaining bucket position data provide output signals different from an output signal from operation apparatus 25.

Control point selection unit 262 compares first distance d1 and second distance d2 with each other. Control point selection unit 262 compares first distance d1 and second distance d2 with line distance h (FIGS. 5 to 7) representing a distance between intervention line C and design topography U. Control point selection unit 262 selects a shorter distance of first distance d1 and second distance d2, and when the shorter distance is equal to or smaller than line distance h, it selects a monitoring point corresponding to the shorter distance as a control point to be used in boom lowering intervention control. Control point selection unit 262 outputs information on the selected control point to adjusted speed determination unit 264.

In an example where first distance d1 is shorter than second distance d2 (d1<d2), cutting edge 8*a* which is a first monitoring point of a plurality of monitoring points (cutting edge 8*a* and rear surface end 8*b*) is selected as the control point because first distance d1 represents a distance between cutting edge 8*a* and design topography U. In an example where second distance d2 is shorter than first distance d1 (d1>d2), rear surface end 8*b* which is a second monitoring point of the plurality of monitoring points (cutting edge 8*a* and rear surface end 8*b*) is selected as the control point because second distance d2 represents a distance between rear surface end 8*b* and design topography U.

Speed obtaining unit 263 obtains a speed of bucket 8 corresponding to an operation of the lever of operation apparatus 25. Speed obtaining unit 263 calculates a speed of cutting edge 8*a* with respect to design topography U and a speed of rear surface end 8*b* with respect to design topography U based on a boom operation command for operating boom 6, an arm operation command for operating arm 7, and a bucket operation command for operating bucket 8. Speed obtaining unit 263 outputs a speed of cutting edge 8*a* and a speed of rear surface end 8*b* to adjusted speed determination unit 264.

Adjusted speed determination unit 264 determines a speed of boom 6 adjusted for moving the control point selected by control point selection unit 262 along design topography U. A speed vector of the control point in the direction perpendicular to design topography U is obtained based on the speed of the control point obtained by speed obtaining unit 263, and the control point being about to move in a direction away from design topography U is distinguished based on the speed vector.

When bucket 8 moves in such a manner that the control point moves away from design topography U, boom lowering intervention control for forcibly lowering boom 6 is carried out. A speed of the control point to move away from design topography U is lowered by lowering boom 6. By operating boom 6 so as to set magnitude of the speed vector of the control point in the direction perpendicular to design topography U to zero, the control point can be moved along design topography U. Adjusted speed determination unit 264 determines a speed of lowering of boom 6 necessary for moving the control point along design topography U and outputs the determined speed of lowering of boom 6 to hydraulic cylinder control unit 265.

Hydraulic cylinder control unit 265 determines an opening of control valve 27 connected to boom cylinder 10 so as to drive boom 6 in accordance with the speed of lowering of boom 6 determined by adjusted speed determination unit 264. Hydraulic cylinder control unit 265 outputs a control command indicating the opening of control valve 27 to control valve 27. Thus, control valve 27 connected to boom cylinder 10 is controlled, a flow rate of hydraulic oil supplied to boom cylinder 10 through control valve 27 is regulated, and intervention control of boom 6 under land grading control (excavation limit control) is carried out.

Figure 14:
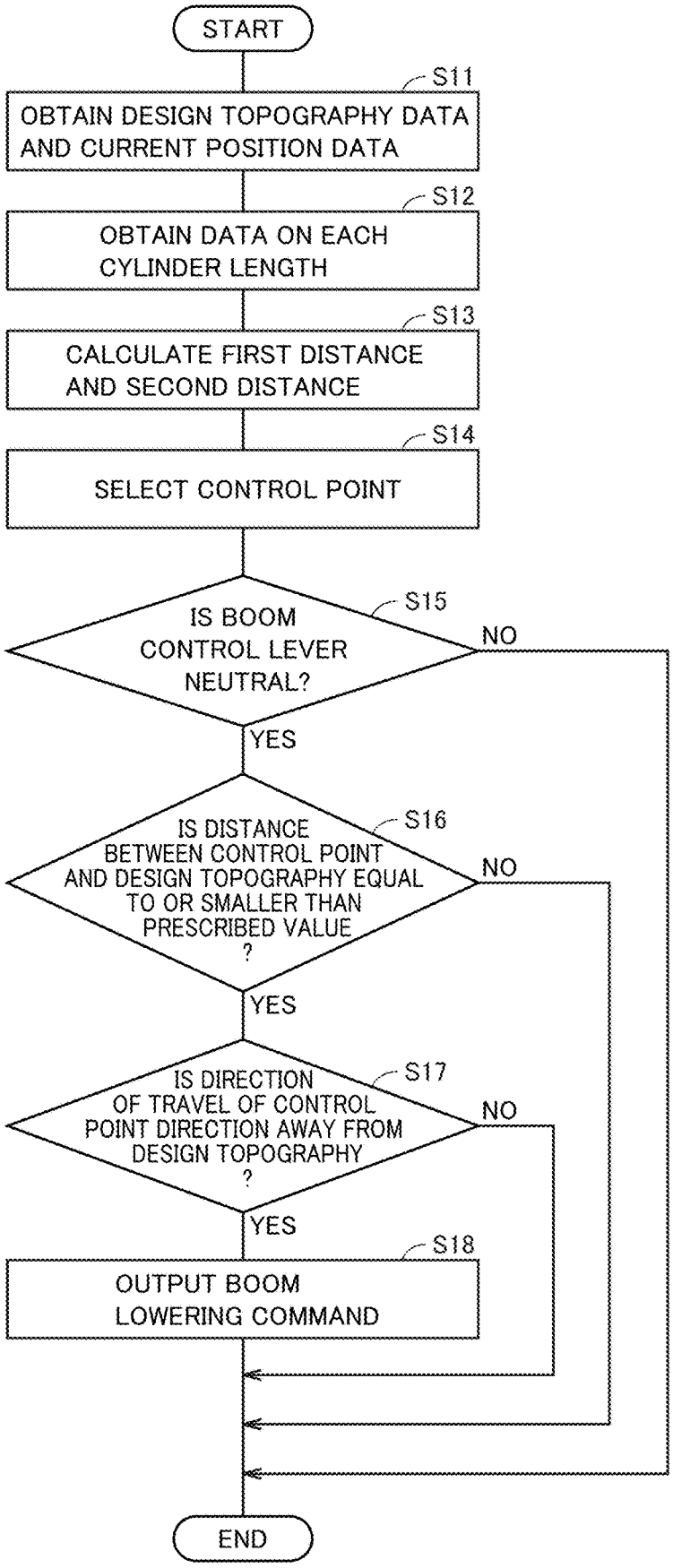
FIG. 14 is a flowchart for illustrating an operation of the control system based on the embodiment.

FIG. 14 is a flowchart for illustrating an operation of control system 200 based on the embodiment. FIG. 14 shows the flowchart when control system 200 carries out boom lowering intervention control.

As shown in FIG. 14, in step S11, control system 200 obtains design topography data and current position data of earthmoving machine 100. Control system 200 sets design topography U and bucket position data.

Then, in step S12, control system 200 obtains cylinder length data L. Control system 200 obtains a stroke length of boom cylinder 10 (a boom cylinder length), a stroke length of arm cylinder 11 (an arm cylinder length), and a stroke length of bucket cylinder 12 (a bucket cylinder length).

Then, in step S13, control system 200 calculates first distance d1 and second distance d2. Specifically, distance calculation unit 261 calculates first distance d1 and second distance d2 based on design topography U, the bucket position data, and cylinder length data L.

Then, in step S14, control system 200 selects a control point. Specifically, control point selection unit 262 compares first distance d1 and second distance d2 with each other. Control point selection unit 262 selects as the control point, a monitoring point shorter in distance from design topography U of a plurality of monitoring points (cutting edge 8*a* and rear surface end 8*b*).

Then, in step S15, control system 200 determines whether or not a boom control lever (first control lever 25R shown in FIGS. 3 and 4 in the embodiment described above) which is an operation apparatus for operating boom 6 is neutral. Namely, whether or not first control lever 25R is operated in a direction corresponding to an operation of boom 6 (the fore/aft direction in the embodiment described above) is determined. When first control lever 25R is operated in the fore/aft direction, a pressure of the pilot oil supplied to oil path 451 connected to direction control valve 64 which controls an operation of boom cylinder 10 is varied. Variation in pilot oil pressure is detected by pressure sensor 66. A result of detection by pressure sensor 66 is output to work implement controller 26.

A prescribed value of the pilot oil pressure corresponding to first control lever 25R not being operated (neutral) is stored in advance in work implement controller 26. Work implement controller 26 determines whether or not the value of the pilot oil pressure input to work implement controller 26 matches with the prescribed value. When the value of the pilot oil pressure matches with the prescribed value, first control lever 25R is determined as not being operated but in a neutral state. When it is not the case, first control lever 25R is determined as being operated by an operator and not in the neutral state.

When the boom control lever is neutral (YES in step S15), control system 200 determines in next step S16 whether or not a distance between the control point and design topography U is equal to or smaller than a prescribed value. Specifically, work implement controller 26 determines whether or not a shorter distance of first distance d1 and second distance d2 is equal to or smaller than line distance h (FIGS. 5 to 7) representing a distance between intervention line C and design topography U. A threshold value (prescribed value) of the distance between the control point and design topography U is defined as line distance h.

When the distance between the control point and design topography U is equal to or smaller than line distance h (YES in step S16), control system 200 determines in next step S17 whether or not a direction of travel of the control point is a direction away from design topography U. Specifically, speed obtaining unit 263 obtains a speed of the control point based on design topography U, the bucket position data, and cylinder length data L, as well as on an operation command from operation apparatus 25. Whether or not work implement 2 is operating in such a manner that the control point comes closer to or moves away from design topography U is determined by converting the speed of the control point into a speed component in the direction perpendicular to design topography U.

When it is determined that work implement 2 is operating in such a manner that the control point moves away from design topography U (YES in step S17), control system 200 outputs a boom lowering command in next step S18. Specifically, adjusted speed determination unit 264 determines a speed of lowering of boom 6 necessary for moving the control point along design topography U. Hydraulic cylinder control unit 265 outputs to control valve 27, a command signal indicating the opening of control valve 27 for performing an operation to lower boom 6 in accordance with the determined speed of lowering.

Then, the process ends (end). When the boom control lever is not neutral in the determination in step S15 (NO in step S15), when the distance between the control point and design topography U is greater than line distance h in the determination in step S16 (NO in step S16), or when work implement 2 is operating in such a manner that the control point comes closer to design topography U in the determination in step S17 (NO in step S17), the process ends without outputting a boom lowering command (end).

Figure 15:
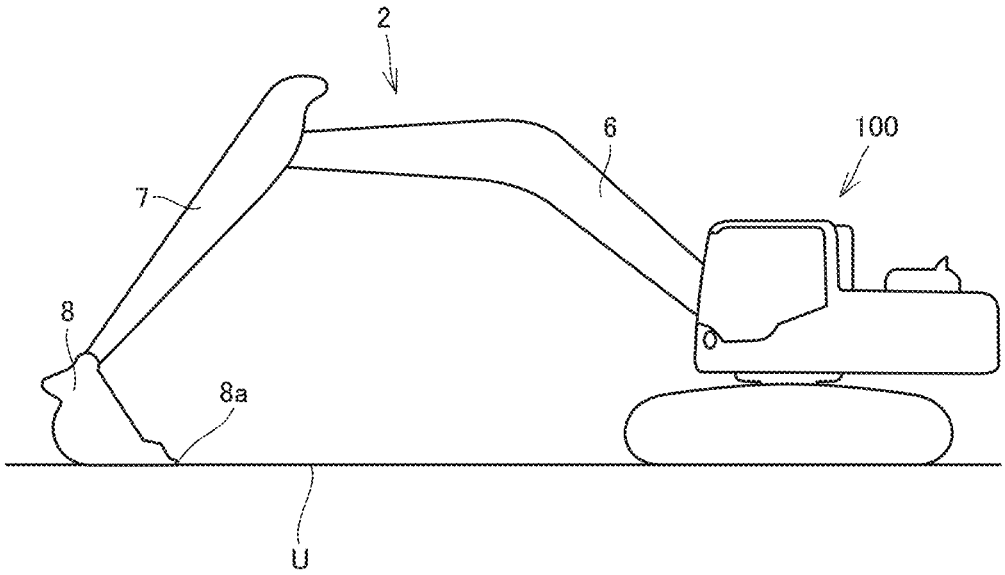
FIG. 15 is a first diagram schematically showing an operation of the work implement when land grading control in the embodiment is carried out.
Figure 16:
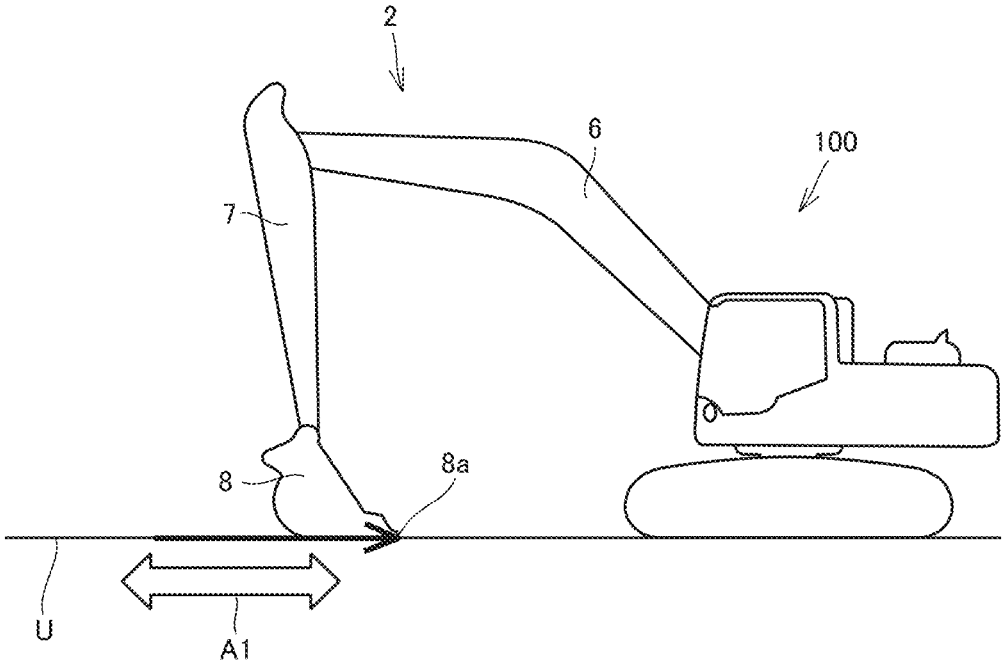
FIG. 16 is a second diagram schematically showing an operation of the work implement when land grading control in the embodiment is carried out.
Figure 17:
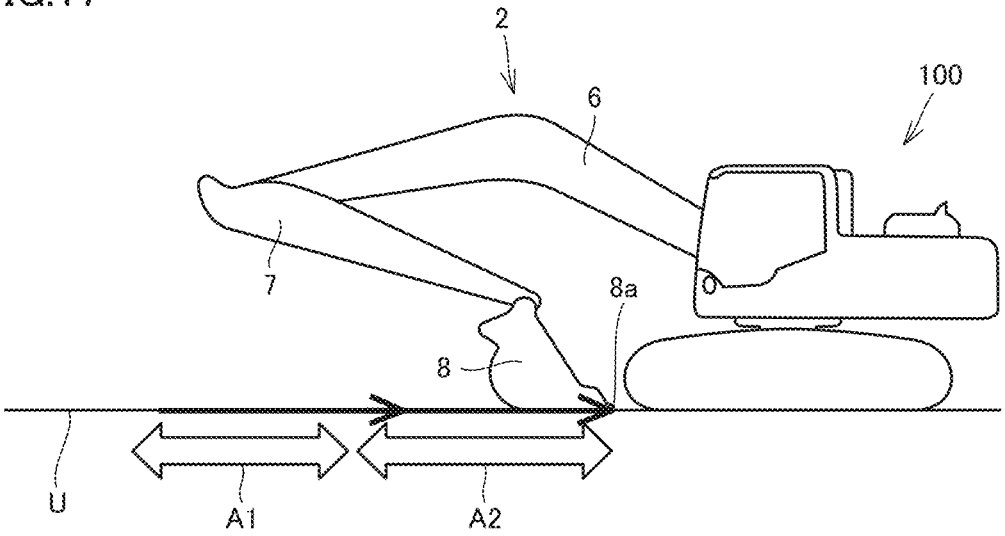
FIG. 17 is a third diagram schematically showing an operation of the work implement when land grading control in the embodiment is carried out.

FIGS. 15 to 17 are diagrams schematically showing an operation of work implement 2 when land grading control in the embodiment is carried out. It is assumed in the embodiment shown in FIGS. 15 to 17 that first distance d1 is shorter than second distance d2 and hence cutting edge 8*a* of bucket 8 is selected as the control point to be used for land grading control. First distance d1 is assumed to be equal to or smaller than line distance h.

The operator performs an operation to move arm 7 in a direction of excavation from a state in which cutting edge 8*a* of bucket 8 is in registration with design topography U shown in FIG. 15. As boom 6 automatically moves up, cutting edge 8*a* moves along design topography U as shown with an arrow in FIG. 16 and cutting edge 8*a* horizontally levels the ground. Land grading to design topography U being carried out only with an excavation operation by arm 7 in area A1 shown with a hollow double-headed arrow in FIG. 16 is the same as in the example of land grading control before application of the present invention described with reference to FIGS. 10 and 11.

In the embodiment, when an excavation operation by arm 7 is continued and cutting edge 8*a* starts to move in a direction away from design topography U, intervention control to forcibly lower boom 6 is carried out. Consequently, as shown with an arrow and a hollow double-headed arrow in FIG. 17, also in area A2, cutting edge 8*a* of bucket 8 can be moved along design topography U only by the excavation operation by arm 7 and land grading to design topography U can automatically be carried out.

As described with reference to FIG. 3, an operation of arm 7 is performed by using second control lever 25L. According to the present embodiment, both of an operation to raise boom 6 and an operation to lower boom 6 are automatically controlled so that cutting edge 8*a* of bucket 8 can be moved along design topography U with a simplified operation simply by an operator of second control lever 25L with one hand. Therefore, topography of a wide area over the entire areas A1 and A2 shown in FIG. 17 can accurately be graded to design topography U set as an aimed shape.

Figure 18:
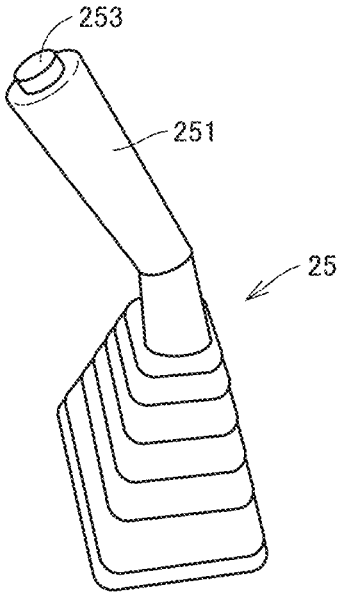
FIG. 18 is a perspective view of an operation apparatus.

FIG. 18 is a perspective view of operation apparatus 25. As shown in FIG. 18, a control lever 251 of operation apparatus 25 has a push button switch 253. Push button switch 253 may be located at an upper end (a top portion) of control lever 251 as shown in FIG. 18 or a side portion thereof.

When push button switch 253 is pressed during boom lowering intervention control, work implement controller 26 suspends boom lowering intervention control while push button switch 253 is pressed. In this case, first distance d1 and second distance d2 (FIGS. 6 and 7) are successively varied. When pressing of push button switch 253 ends, whether or not to resume boom lowering intervention control is determined in accordance with the flow of boom lowering intervention control shown in FIG. 14.

Push button switch 253 may be provided in second control lever 25L (FIGS. 3 and 4) operated for driving arm 7. Alternatively, a switch for suspending boom lowering intervention control may be provided in a dashboard implementing input portion 321 (FIG. 3) arranged in front of operator's seat 4S (FIG. 1) in operator's cab 4.

When the operator operates boom 6 during boom lowering intervention control, boom lowering intervention control may be stopped and the operation by the operator may be prioritized. Specifically, when an operation of first control lever 25R for driving boom 6 by the operator is detected, control valve 27C (FIG. 4) may fully be closed and control valve 27A (FIG. 4) may fully be opened such that a pilot oil pressure regulated based on an amount of operation of first control lever 25R is applied to direction control valve 64 (FIG. 4).

Though bucket 8 described above is constructed such that two monitoring points of cutting edge 8*a* and rear surface end 8*b* are set, only a single monitoring point or three or more monitoring points may be set in bucket 8. When three or more monitoring points are set, distance calculation unit 261 calculates a distance between each monitoring point and design topography U and control point selection unit 262 selects a monitoring point corresponding to the shortest distance among the plurality of distances as a control point to be used for land grading control.

Though operation apparatus 25 described above is an operation apparatus of a pilot hydraulic type which is coupled to control valve 27 through oil path 451 to be able to detect an operation of operation apparatus 25 by detecting a pilot oil pressure before and after control valve 27 with pressure sensors 66 and 67, the operation apparatus is not limited to such a construction and operation apparatus 25 may be an electronic apparatus. For example, operation apparatus 25 may include a control lever and an operation detector which detects an amount of operation of the control lever, and may be configured such that the operation detector outputs an electric signal in accordance with a direction of operation and an amount of operation of the control lever to work implement controller 26 when the control lever is operated.

Though an embodiment of the present invention has been described above, it should be understood that the embodiment disclosed herein is illustrative and non-restrictive in every respect. The scope of the present invention is defined by the terms of the claims and is intended to include any modifications within the scope and meaning equivalent to the terms of the claims.

REFERENCE SIGNS LIST

1 main body; 2 work implement; 3 revolving unit; 5 traveling apparatus; 6 boom; 7 arm; 8 bucket; 8*a* cutting edge; 8*b* rear surface end; 10 boom cylinder; 11 arm cylinder; 12 bucket cylinder; 16 boom cylinder stroke sensor; 17 arm cylinder stroke sensor; 18 bucket cylinder stroke sensor; 20 position detection apparatus; 21 antenna; 25 operation apparatus; 25L second control lever; 25R first control lever; 26 work implement controller; 27, 27A, 27B, 27C control valve; 28 display controller; 29, 322 display portion; 30 sensor controller; 40A bottom side oil chamber; 40B head side oil chamber; 50 pump flow path; 51 shuttle valve; 60 hydraulic cylinder; 63 revolution motor; 64 direction control valve; 65 spool stroke sensor; 66, 67, 68 pressure sensor; 100 earthmoving machine; 200 control system; 251 control lever; 253 push button switch; 261 distance calculation unit; 262 control point selection unit; 263 speed obtaining unit; 264 adjusted speed determination unit; 265 hydraulic cylinder control unit; 300 hydraulic system; 321 input portion; 450 pilot oil path; 451, 451A, 451B, 452, 452A, 452B, 501, 502 oil path; A1, A2 area; C intervention line; U design topography; d1 first distance; d2 second distance; and h line distance.

The invention claimed is:

1. An earthmoving machine comprising:

a work implement including a boom, an arm, and a bucket;

a distance calculation unit which calculates a distance between a monitoring point in the bucket and design topography representing an aimed shape of an excavation target; and a control unit which outputs automatically a command signal for lowering the boom when both i) the distance between the monitoring point and the design topography is equal to or smaller than a prescribed value and ii) the bucket is expected to move in such a direction that the monitoring point moves away from the design topography as a result of an operation of the arm.

2. The earthmoving machine according to claim 1, wherein the distance calculation unit calculates distances between a plurality of monitoring points in the bucket and the design topography, wherein each monitoring point of the plurality of monitoring points is a different point in the bucket, and the control unit outputs the command signal when the bucket is expected to move in such a direction that a monitoring point of which distance from the design topography is smallest among the plurality of monitoring points moves away from the design topography.

3. The earthmoving machine according to claim 1, the earthmoving machine comprising:

a boom cylinder which drives the boom; and an operation apparatus which accepts an operation by an operator for operating the boom cylinder, wherein the control unit automatically outputs the command signal for lowering the boom further when iii) the operation apparatus is not being operated.

4. A method of controlling an earthmoving machine having a work implement including a boom, an arm, and a bucket, the method comprising:

calculating a distance between a monitoring point in the bucket and design topography representing an aimed shape of an excavation target; and outputting automatically a command signal for lowering the boom when both i) the distance between the monitoring point and the design topography is equal to or smaller than a prescribed value and ii) the bucket is expected to move in such a direction that the monitoring point moves away from the design topography as a result of an operation of the arm.

* * * * *